United States Patent [19]

Nakamura et al.

[11] Patent Number: 4,968,598

[45] Date of Patent: Nov. 6, 1990

[54] HEAT DEVELOPABLE COLOR LIGHT-SENSITIVE MATERIAL

[75] Inventors: Koki Nakamura; Hiroyuki Hirai, both of Kanagawa, Japan

[73] Assignee: Fuji Photo Film Co., Ltd., Kanagawa, Japan

[21] Appl. No.: 328,394

[22] Filed: Mar. 24, 1989

[30] Foreign Application Priority Data

Mar. 24, 1988 [JP] Japan ..... 63-70352

[51] Int. Cl.[5] ..... G03C 1/06

[52] U.S. Cl. ..... 430/617; 430/214; 430/619

[58] Field of Search ..... 430/214, 617, 619

[56] References Cited

U.S. PATENT DOCUMENTS 4,770,981 9/1988 Komamura et al. ..... 430/505
4,782,004 11/1988 Takeuchi et al. ..... 430/203
4,783,396 11/1988 Nakamura et al. ..... 430/353

FOREIGN PATENT DOCUMENTS 0200011 11/1986 European Pat. Off. .
0220746 5/1987 European Pat. Off. .

*Primary Examiner*—Paul R. Michl
*Assistant Examiner*—Janet C. Baxter
*Attorney, Agent, or Firm*—Sughrue, Mion, Zinn, Macpeak & Seas

[57] ABSTRACT

A heat developable color light-sensitive material comprising a support having thereon at least light-sensitive silver halide, a reducing agent and/or a reducing agent precursor, a binder, a dye providing substance which releases a mobile dye in counter-correspondence to a latent image formed by imagewise exposure, and an oxidizable compound which has a single bond cleaved by reduction and which does not release any substance having a photographic effect.

8 Claims, No Drawings

HEAT DEVELOPABLE COLOR LIGHT-SENSITIVE MATERIAL

FIELD OF THE INVENTION

This invention relates to a heat developable color light-sensitive material, and more particularly to a heat developable color light-sensitive material suitable for use in obtaining a positive color image by a diffusion transfer process.

BACKGROUND OF THE INVENTION

Various methods for obtaining a positive dye image by a heat development diffusion transfer process have been proposed. For example, JP-A-59-165054 (the term "JP-A" as used herein means an "unexamined published Japanese patent application") discloses a method in which a dye developing agent is used and a positive dye image is formed by wet development or heat development.

JP-A-59-152440 discloses a method in which a positive dye image is formed by a heat development process using a reducible non-diffusible dye providing substance which releases a mobile dye under alkaline conditions and/or heating, but no longer releases any dye when it is reacted with exposed silver halide.

European Patent No. 220,746A2 discloses a method in which a positive dye image is formed by a heat development process using a non-diffusible dye providing substance which releases a mobile dye when it is reduced by a reducing substance (electron donor and/or electron transfer agent).

However, the above-described known positive dye image forming methods provide an inferior image in that there can be obtained only a positive dye image having low density and high stain.

SUMMARY OF THE INVENTION

Accordingly, it is an object of the present invention to provide a color light-sensitive material which gives a positive dye image which has high density, is low in stain and which has excellent image properties.

The above object has been achieved by providing a color light-sensitive material comprising a support having thereon at least a light-sensitive silver halide, a reducing agent and/or a reducing agent precursor, a binder, a dye providing substance which releases a mobile dye in counter-correspondence to a latent image formed by imagewise exposure, and an oxidizable compound which has a single bond cleaved by reduction and which does not release any substance having a photographic effect.

DETAILED DESCRIPTION OF THE INVENTION

The "oxidizable compound which has a single bond cleaved by reduction and which does not release any substance having a photographic effect" as referred to herein means a compound which does not release any substance even when a single bond is cleaved or a compound which contains a group which is released upon cleavage of a single bond and which does not exhibit a photographic effect in a system where said compound is used.

Examples of a group which has a photographic effect include development inhibitors, development accelerators, nucleating agents, couplers, diffusible or non-diffusible dyes, desilvering accelerators, desilvering inhibitors, silver halide solvents, competing compounds, developing agents, developing auxiliaries, fixing accelerators, fixing inhibitors, image stabilizers, toning agents, processing dependence improving agents, dot improving agents, color image stabilizers, photographic dyes, surfactants, hardeners, desensitizers, contrast intensifiers, chelating agents and fluorescent whitening agents as well as precursors thereof.

The above-described compound incorporated in the light-sensitive material of the present invention will be illustrated in detail below.

As such compounds, preferred compounds have the following formula (I), in which the N—X bond (e.g., nitrogen-to-oxygen bond, nitrogen-to-nitrogen bond, nitrogen-to-sulfur bond) is cleaved by reduction.

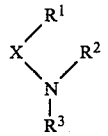

(I)

In formula (I), $R^1$, $R^2$ and $R^3$ each represents a substituent group other than hydrogen atom and at least one of them is an electron-accepting group. N represents nitrogen in formulae herein.

X represents oxygen atom, a sulfur atom or a group of the formula

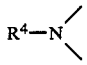

which contains nitrogen atom.

$R^4$ represents a mere bond or a substituent group other than hydrogen atom. When X is a group of the formula

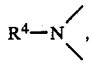

at least one of $R^1$ to $R^4$ is an electron-accepting group.

$R^1$ and $R^2$, $R^2$ and $R^3$, $R^3$ and $R^4$, or $R^4$ and $R^1$ may be combined together to form a ring.

As compounds having formula (I), compounds having the following formula (II) are preferred from the viewpoint of synthesis.

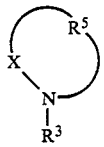

(II)

In formula (II), $R^5$ represents a group which is combined together with X and N to form a three-membered to eight-membered heterocyclic ring. $R^3$ is earlier defined.

$R^3$ and $R^4$, $R^4$ and $R^5$, or $R^5$ and $R^3$ may be combined together to form a ring.

Examples of groups $R^1$, $R^2$, $R^3$ and $R^4$ in the formula (I) or (II) include a nitro group; cyano group; carboxyl group; sulfo group; a halogen atom (e.g., fluorine, chlorine, bromine, iodine); an alkyl group and an aralkyl group (e.g., an unsubstituted or substituted alkyl group and an unsubstituted or substituted aralkyl group such as methyl, trifluoromethyl, benzyl, chloromethyl, dimethylaminomethyl, ethoxycarbonylmethyl, aminomethyl, acetylaminomethyl, ethyl, 2-(4-dodecanoylaminophenyl)ethyl, carboxyethyl, allyl, 3,3,3-trichloropropyl, n-propyl, isopropyl, n-butyl, isobutyl, sec-butyl, t-butyl, n-pentyl, sec-pentyl, t-pentyl, cyclopentyl, n-hexyl, sec-hexyl, t-hexyl, cyclohexyl, n-octyl, sec-octyl, t-octyl, n-decyl, n-undecyl, n-dodecyl, n-tetradecyl, n-pentadecyl, n-hexadecyl, sec-hexadecyl, t-hexadecyl, n-octadecyl, t-octadecyl); an alkenyl group (e.g., an unsubstituted or substituted alkenyl group such as vinyl, 2-chlorovinyl, 1-methylvinyl, 2-cyanovinyl, cyclohexen-1-yl); an alkynyl group (e.g., an unsubstituted or substituted alkynyl group such as ethynyl, 1-propynyl, 2-ethoxycarbonylethynyl); an aryl group (e.g., an unsubstituted or substituted aryl group such as phenyl, naphthyl, 3-hydroxyphenyl, 3-chlorophenyl, 4-acetylaminophenyl, 4-hexadecanesulfonylaminophenyl, 2-methanesulfonyl-4-nitrophenyl, 3-nitrophenyl, 4-methoxyphenyl, 4-acetylaminophenyl, 4-methanesulfonylphenyl, 2,4-dimethylphenyl, 4-tetradecyloxyphenyl); a heterocyclic group (e.g., an unsubstituted or substituted heterocyclic group such as 1-imidazolyl, 2-furyl, 2-pyridyl, 5-nitro-2-pyridyl, 3-pyridyl, 3,5-dicyano-2-pyridyl, 5-tetrazolyl, 5-phenyl-1-tetrazolyl, 2-benzothiazolyl, 2-benzimidazolyl, 2-benzoxazolyl, 2-oxazolin-2-yl, morpholino); an acyl group (e.g., an unsubstituted or substituted acyl group such as acetyl, propionyl, butyroyl, isobutyrol, 2,2-dimethylpropionyl, benzoyl, 3,4-dichlorobenzoyl, 3-acetylamino-4-methoxybenzoyl, 4-methylbenzoyl); a sulfonyl group (e.g., an unsubstituted or substituted sulfonyl group such as methanesulfonyl, ethanesulfonyl, chloromethanesulfonyl, propanesulfonyl, butanesulfonyl, n-octanesulfonyl, n-dodecanesulfonyl, n-hexadecanesulfonyl, benzenesulfonyl, 4-toluenesulfonyl, 4-n-dodecyloxybenzenesulfonyl); a carbamoyl group (e.g., an unsubstituted or substituted carbamoyl group such as carbamoyl, methylcarbamoyl, dimethylcarbamoyl, bis(2-methoxyethyl)carbamoyl, diethylcarbamoyl, cyclohexylcarbamoyl, di-n-octylcarbamoyl, 3-dodecyloxypropylcarbamoyl, hexadecylcarbamoyl, 3-(2,4-di-t-pentylphenoxy)propylcarbamoyl), 3-octanesulfonylaminophenylcarbamoyl, di-n-octadecylcarbamoyl); and a sulfamoyl group (e.g., an unsubstituted or substituted sulfamoyl group such as sulfamoyl, methylsulfamoyl, dimethylsulfamoyl, bis(2-methoxyethyl)sulfamoyl, diethylsulfamoyl, di-n-butylsulfamoyl, methyl-n-octylsulfamoyl, n-hexadecylmethylsulfamoyl, 3-ethoxypropylmethylsulfamoyl, N-phenyl-N-methylsulfamoyl, N-methylsulfamoyl, 4-decyloxyphenylsulfamoyl, methyloctadecylsulfamoyl).

At least one of $R^1$ to $R^4$ is an electron-accepting group.

As the electron-accepting group, any of groups capable of accepting electron can be used. However, groups represented by the following formula (EAG) are preferred.

(EAG)

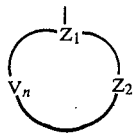

In formula (EAG), $Z_1$ represents

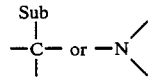

$V_n$ represents an atomic group which forms a three-membered to eight-membered ring together with $Z_1$ and $Z_2$ and n is an integer of from 3 to 8. Vn is a member selected from the group consisting of $V_3$: $—Z_3—$, $V_4$: $—Z_3—Z_4—$, $V_5$: $—Z_3—Z_4—Z_5—$, $V_6$: $—Z_3—Z_4—Z_5—Z_6—$, $V_7$: $—Z_3—Z_4—Z_5—Z_6—Z_7—$: and $V_8$: $—Z_3—Z_4—Z_5—Z_6—Z_7—Z_8—$.

$Z_2$ to $Z_8$ represent each

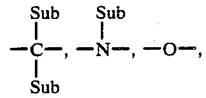

—S—or—$SO_2$—.

Each Sub is a mere bond ($\pi$ bond), hydrogen atom or a substituent group as described below. The Sub groups may be the same or different groups, or may be combined together to form a three-membered to eight-membered saturated or unsaturated carbon ring or heterocyclic ring. In formula [EAG], the Sub groups are chosen so that the sum total of the Hammett's substituent constant $\sigma P$ of the substituent groups is preferably at least +0.09, more preferably at least +0.3, most preferably at least +0.45.

Examples of the Sub substituent groups (preferably having from 0 to 40 carbon atoms) include a substituted or unsubstituted alkyl group (e.g., methyl, ethyl, sec-butyl, t-octyl, benzyl, cyclohexyl, chloromethyl, dimethylaminomethyl, n-hexadecyl, trifluoromethyl, 3,3,3-trichloropropyl, methoxycarbonylmethyl), a substituted or unsubstituted alkenyl group (e.g., vinyl, 2-chlorovinyl, 1-methylvinyl), a substituted or unsubstituted alkynyl group (e.g., ethynyl, propynyl), a cyano group, a nitro group, a halogen atom (e.g., fluorine, chlorine, bromine, iodine), a residue of a substituted or unsubstituted heterocyclic ring (e.g., 2-pyridyl, 1-imidazolyl, benzothiazol-2-yl, morpholino, benzoxazol-2-yl), a sulfo group, a carboxyl group, a substituted or unsubstituted aryloxycarbonyl or alkoxycarbonyl group (e.g., methoxycarbonyl, ethoxycarbonyl, tetradecyloxycarbonyl, 2-methoxyethoxycarbonyl, phenoxycarbony, 4-cyanophenylcarbonyl, 2-chlorophenoxycarbonyl), a substituted or unsubstituted carbamoyl group (e.g., carbamoyl, methylcarbamoyl, diethylcarbamoyl, methylhexadecylcarbamoyl, methyloctadecylcarbamoyl, 2,4,6-trichlorophenylcarbamoyl, N-ethyl-N-phenylcarbamoyl, 3-hexadecylsulfamoylcarbamoyl), a hydroxyl group, a substituted or unsubstituted azo group (e.g., phenylazo, p-methoxyphenylazo, 2-cyano-4-methanesulfonylphenylazo), a substituted or unsubstituted aryloxy or alkoxy group (e.g., methoxy, ethoxy, dodecyloxy, benzyloxy, phenoxy, 4-methoxyphenoxy, 3-acetylaminophenoxy, 3-methoxycarbonylpropyloxy, 2-trimethylammonioethoxy), a sulfino group, a sulfeno group, mercapto group, a substituted or unsubstituted acyl group (e.g., acetyl, trifluoroacetyl, n-butyroyl, t-butyroyl, benzoyl, 2-carboxybenzoyl, 3-nitrobonzoyl, formyl), a substituted or unsubstituted aryl- or alkylthio group (e.g., methylthio, ethylthio, t-octylthio, hexadecylthio, phenylthio, 2,4,5-trichlorophenylthio, 2-methoxy-5-t-octylphenylthio, 2-acetylaminophenylthio), a substituted or unsubstituted aryl group (e.g., phenyl, naphthyl, 3-sulfophenyl, 4-methoxyphenyl, 3-lauroylaminophenyl), a substituted or unsubstituted sulfonyl group (e.g., methylsulfonyl, chloromethylsulfonyl, n-octylsulfonyl, n-hexadecylsulfonyl, sec-octylsulfonyl, p-toluenesulfonyl, 4-chlorophenylsulfonyl, 4-dodecylphenylsulfonyl, 4-dodecyloxyphenylsulfonyl, 4-nitrophenylsulfonyl), a substituted or unsubstituted sulfinyl group (e.g., methylsulfinyl, dodecylsulfinyl, phenylsulfinyl, 4-nitrophenylsulfinyl), a substituted or unsubstituted amino group (e.g., methylamino, diethylamino, amino, methyloctadecylamino, phenylamino, ethylphenylamino, 3-tetradecylsulfamoylphenylamino, acetylamino, trifluoroacetylamino, N-hexadecylacetylamino, N-methylbenzoylamino, methoxycarbonylamino, phenoxycarbonylmethylamino, N-methoxyacetylamino, amidinoamino, phenylaminocarbonylamino, 4-cyanophenylaminocarbonylamino, N-ethylethoxycarbonylamino, N-methyldodecylsulfonylamino, N-(2-cyanoethyl)-p-toluenesulfonylamino, hexadecylsulfonylamino, trimethylammonio), a substituted or unsubstituted sulfamoyl group (e.g., dimethylsulfamoyl, sulfamoyl, hexadecylsulfamoyl, methyloctadecylsulfamoyl, methylhexadecylsulfamoyl, 2-cyanoethylhexadecylsulfamoyl, phenylsulfamoyl, N-(3,4-dimethylphenyl)-N-octylsulfamoyl, dibutylsulfamoyl, dioctadecylsulfamoyl, bis(2-methoxycarbonylethyl)sulfamoyl), a substituted or unsubstituted acyloxy group (e.g., acetoxy, benzoyloxy, chloroacetoxy), and a substituted or unsubstituted sulfonyloxy group (e.g., methylsulfonyloxy, p-toluenesulfonyloxy, p-chlorophenylsulfonyloxy).

Typical examples of electron-accepting groups include aryl groups substituted with at least one electron attractive group (e.g., 4-nitrophenyl, 2-nitro-4-N-methyl-N-octadecylsulfamoylphenyl, 2-N,N-dimethylsulfamoyl-4-nitrophenyl, 2-cyano-4-octadecylsulfonylphenyl, 2,4-dinitrophenyl, 2,4,6-tricyanophenyl, 2-nitro-4-N-methyl-N-octadecylcarbamoylphenyl, 2-nitro-5-octylthiophenyl, 2,4-dimethanesulfonylphenyl, 3,5-dinitrophenyl, 2-chloro-4-nitro-5-methylphenyl, 2-nitro-3,5-dimethyl-4-tetradecylsulfonylphenyl, 2,4-dinitronaphthyl, 2-ethylcarbamoyl-4nitrophenyl, 2,4-bis-dodecylsulfonyl-5-trifluoromethylphenyl, 2,3,4,5,6-pentafluorophenyl, 2-acetyl-4-nitrophenyl, 2,4-diacetylphenyl, 2-nitro-4-trifluoromethylphenyl), substituted or unsubstituted heterocyclic rings (e.g., 2-pyridyl, 2-pyrazyl, 5-nitro-2-pyridyl, 5-N-hexadecylcarbamoyl-2-pyridyl, 4-pyridyl, 3,5-dicyano-2-pyridyl, 5-dodecylsulfonyl-2-pyridyl, 5-cyano-2-pyrazyl, 4-nitrothiophen-2-yl, 5-nitro-1,2-dimethylimidazol-4-yl, 3,5-diacetyl-2-pyridyl, 1-dodecyl-5-carbamoylpyridinium-2-yl), substituted or unsubstituted quinones (e.g., 1,4-benzoquinone-2-yl, 3,5,6-trimethyl-1,4-benzoquinone-2-yl, 3-methyl-1,4-naphthoquinone-2-yl, 3,6-dimethyl-5-hexadecylthio-1,4-benzoquinone-2-yl, 5-pentadecyl-1,4-benzoquinone-4-yl) as well as nitroalkyl groups (e.g., 2-nitro-2-propyl), nitroalkenyl groups (e.g., 2-nitroethenyl), monovalent groups of α-diketo compounds (e.g., 2-oxopropanoyl), nitroalkanes and nitroalkanes in addition to the above-described vinyloges.

As described above, $R^5$ represents an atomic group required for forming a three-membered to eight-membered heterocyclic group together with a nitrogen atom and oxygen atom. Typical examples of the heterocyclic ring include the following groups:

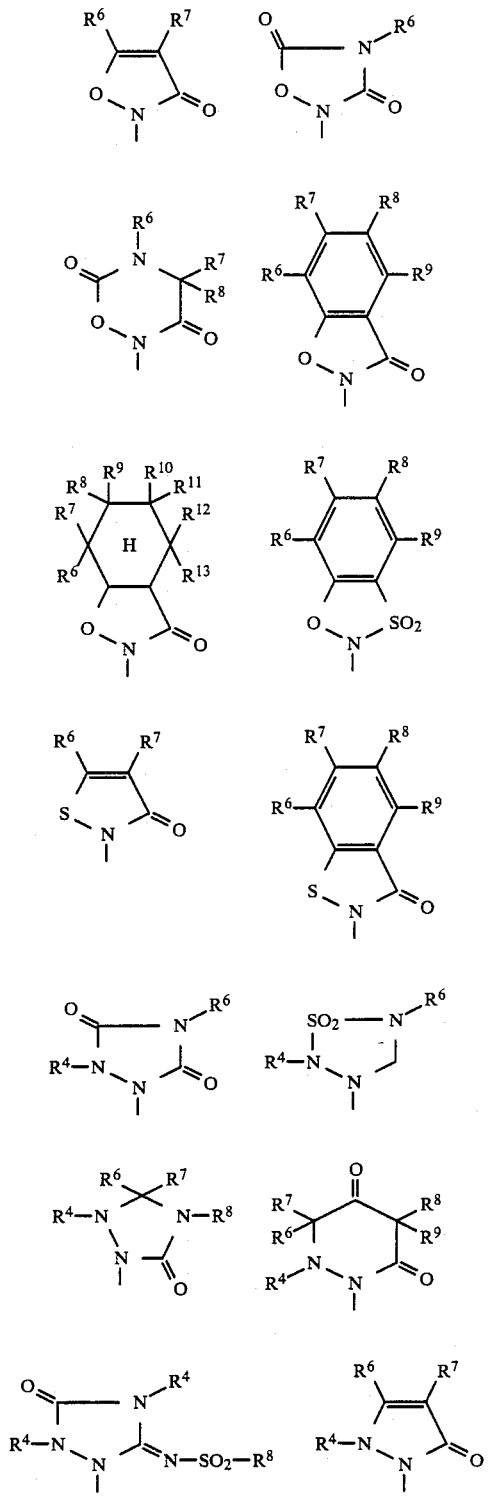

-continued

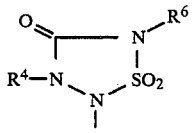

In the above formulas, $R^6$ to $R^{13}$, which may be the same or different, each represents hydrogen atom, an aliphatic group, an aromatic group, a heterocyclic group, an acyl group, an alkoxycarbonyl group, a carbamoyl group, a sulfonyl group, an aryloxycarbonyl group, a sulfamoyl group, a cyano group, a nitro group, a halogen atom, an amino group, an alkoxy group, an aryloxy group, a hydroxyl group, a ureido group, an aminocarbonyloxy group, an alkoxycarbonylamino group, an amido group, a sulfo group, a carboxyl group, a sulfonamido group, an acyloxy group, and an aryloxycarbonylamino group.

Among them, compounds represented by the following formulas exhibit more satisfactory characteristics as the oxidizable compound.

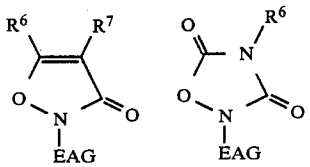

In the above formulas, EAG is the same as defined above.

$R^6$ $R^7$ each represents hydrogen atom or a group which can be substituted, provided that $R^6$ and $R^7$ may be taken together to form a saturated or unsubstituted carbocyclic or heterocyclic group.

Preferred examples of $R^6$ and $R^7$ include hydrogen atom, an alkyl group (e.g., methyl, ethyl, t-butyl, octadecyl, phenethyl, carboxymethyl), an aryl group (e.g., phenyl, 3-nitrophenyl, 4-methoxyphenyl, 4-acetylaminophenyl, 4-methanesulfonylphenyl, 2,4-dimethylphenyl, 4-tetradecyloxyphenyl), a heterocyclic group (e.g., 2-pyridyl, 2-furyl, 4-pyridyl), an acyl group (e.g., acetyl, benzoyl, dodecanoyl, 4-acetamidobenzoyl), an alkoxycarbamoyl group (e.g., methoxycarbonyl, methoxyethoxycarbonyl, butoxycarbonyl), a carbamoyl group (e.g., carbamoyl, ethylcarbamoyl, phenylcarbamoyl, diethylcarbamoyl, dodecylcarbamoyl), a sulfonyl group (e.g., methanesulfonyl, p-toluenesulfonyl, hexadecylsulfonyl), an aryloxycarbonyl (e.g., phenoxycarbonyl, naphthyloxycarbonyl), a sulfamoyl group (e.g., dimethylsulfamoyl, butylsulfamoyl, phenylsulfamoyl), a cyano group, a nitro group, a halogen atom (e.g., F, cl, Br, I), an amino group (e.g., amino, methylamino, diethylamino, methylphenylamino, 1-pyrrolidino), an alkoxy group (e.g., methoxy, ethoxy, octyloxy, isopropyloxy), an aryloxy group (e.g., phenoxy, 4-chlorophenoxy, 3-pentadecylphenoxy), a hydroxyl group, a ureido group (e.g., 3-methylureido, 3diethylureido, 1-methyl-3-phenylureido), an aminocarbonyloxy group (e.g., dibutylaminocarbonyloxy, phenylaminocarbonyloxy, cyclohexylaminocarbonyloxy), an alkoxycarbonylamino group (e.g., methoxycarbonylamino, hexyloxycarbonylamino), an amido group (e.g., acetamido, benzamido), a sulfo group or its salt, a carboxyl group or its salt, a sulfonamido group (e.g., methanesulfonamido, phenylsulfonamido, dodecylsulfonamido), an acyloxy group (e.g., acetoxy, benzoyloxy), and an aryloxycarbonylamino group (e.g., phenoxycarbonylamino).

The heterocyclic rings of the present invention are not limited to the above exemplified groups. With regard to the substituent groups, arbitrary substituent groups can be chosen.

Typical examples of compounds which can be used in the present invention include, but are not limited to, the following compounds:

(1)

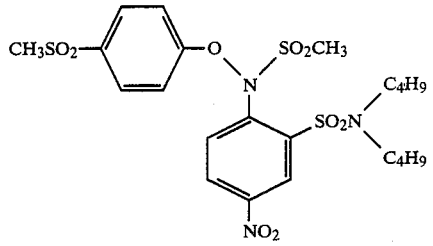

(2)

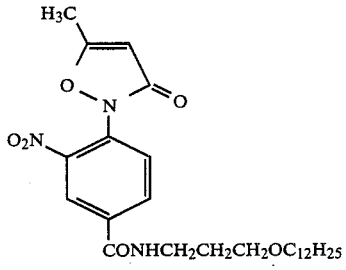

(3)

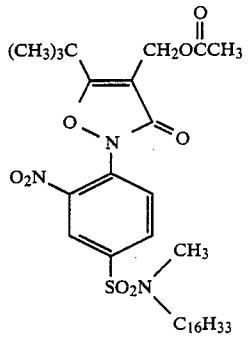

(4)

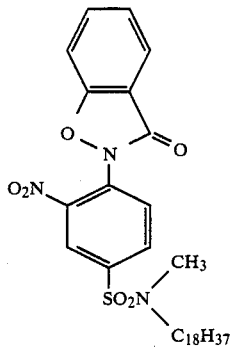

-continued
(5)
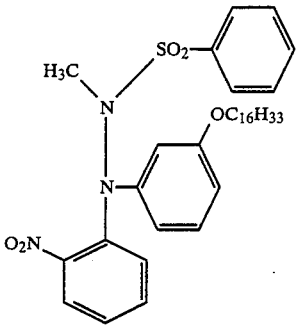
(6)
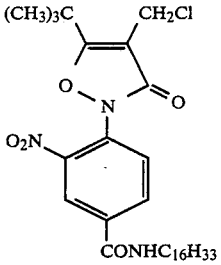
(7)
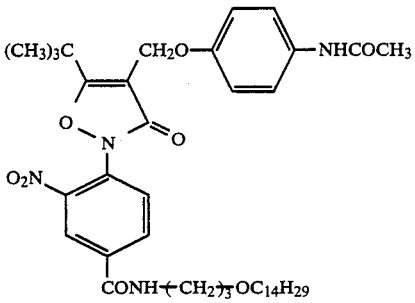
(8)
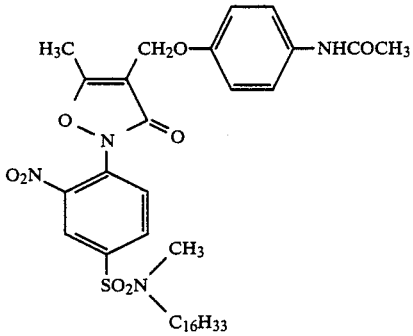
(9)
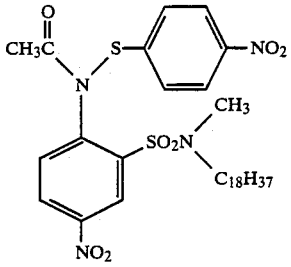
-continued
(10)
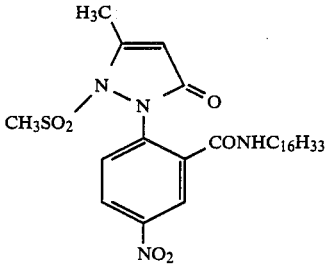
(11)
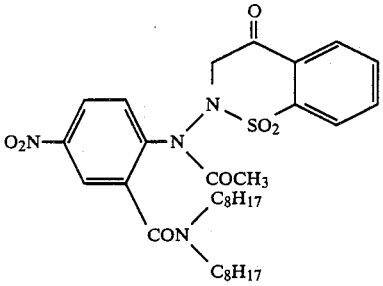
(12)
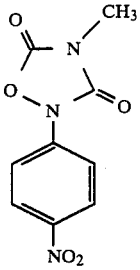
(13)
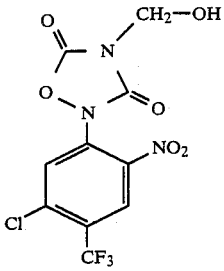
(14)
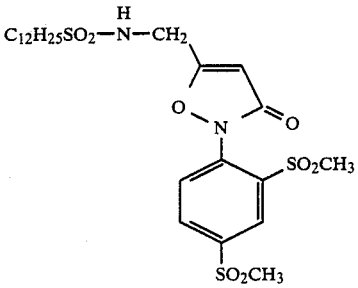

-continued
(15)
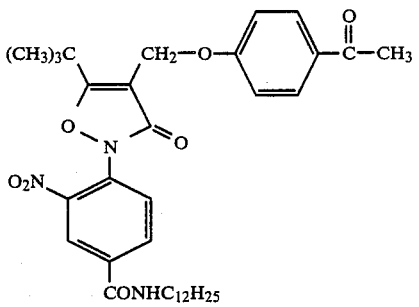
(16)
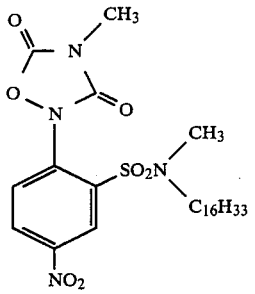
(17)
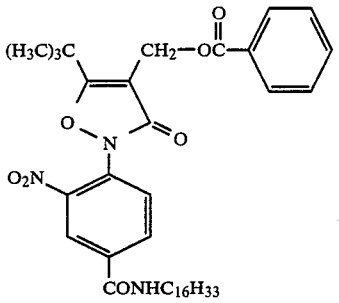
(18)
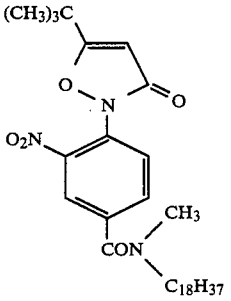
(19)
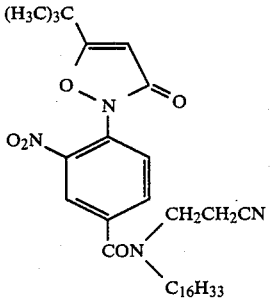
-continued
(20)
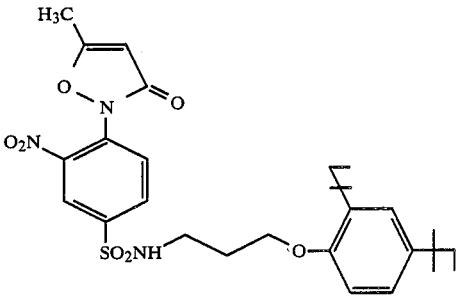
(21)
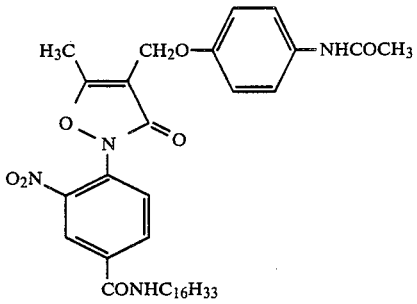
(22)
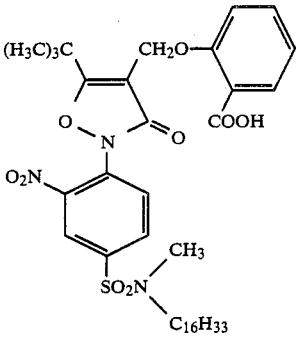
(23)
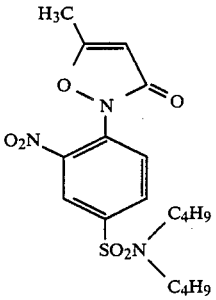
(24)
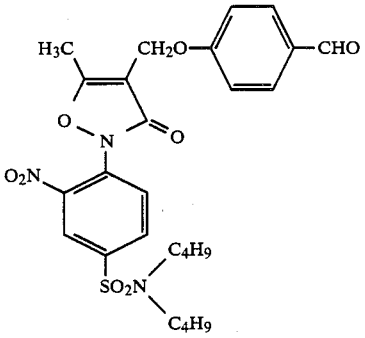

-continued (25)

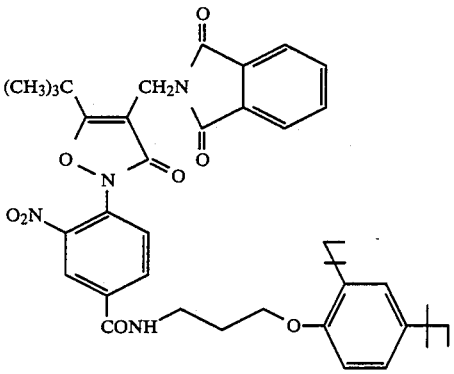

(26)

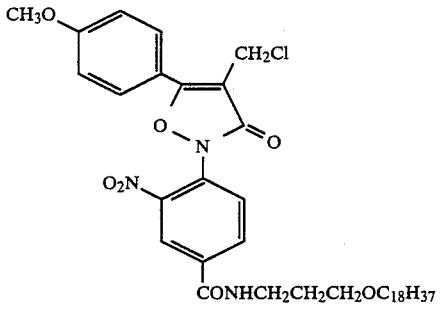

(27)

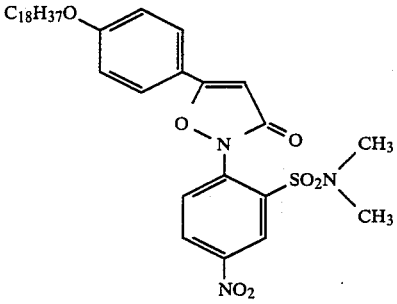

(28)

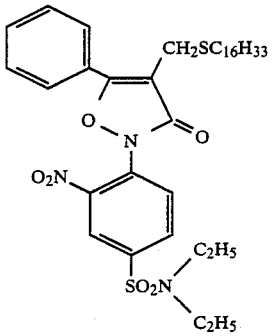

(29)

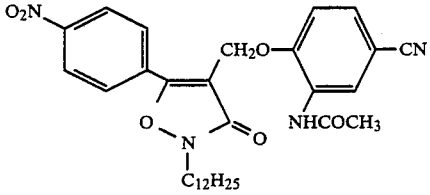

-continued (30)

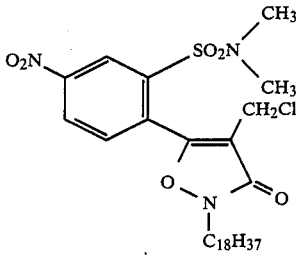

(31)

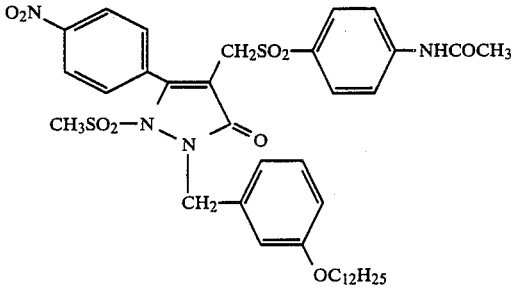

(32)

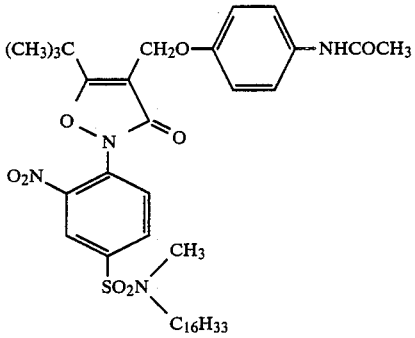

Certain of these compounds are later referenced in the working Examples as used therein.

The compounds of the present invention where X is oxygen, can be synthesized by the method as described in JP-A-62-215270. The compounds where X is a nitrogen-containing group, i.e.,

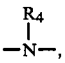

can be synthesized by the method as described in JP-A-63-201653. The compounds where X is sulfur atom can be synthesized by the methods as described in JP-A-62-244048 and JP-A-63-201654.

The heat developable light-sensitive material of the present invention basically comprises a light-sensitive silver halide, a reducing agent and/or a reducing agent precursor, a binder and a dye providing compound which releases a diffusible dye in counter-correspondence to a latent image formed by imagewise exposure, provided on a support. These components are often added to the same layer. However, they may be added to separate layers in such a manner that they can react with one another. For example, when the colored dye providing compound is present in a layer under the silver halide emulsion, a lowering in sensitivity can be prevented.

Combinations of at least three silver halide emulsion layers which are light-sensitive to different regions of the spectrum are used to obtain a wide range of colors in the chromaticity diagram using the three colors yellow, magenta and cyan. For example, there are three layer combinations consisting of a blue sensitive layer, a green sensitive layer and a red sensitive layer, and combinations consisting of a green sensitive layer, a red sensitive layer and an infrared sensitive layer.

The light-sensitive layers can be arranged in the various sequences known for the ordinary types of color light-sensitive material.

Furthermore, each of these light-sensitive layers may be divided into two or more layers, as required.

Various auxiliary layers, such as protective layers, subbing layers, interlayers, yellow filter layers, antihalation layers and backing layers for example, can be established in the heat developable light-sensitive material.

The silver halide which may be used in the present invention may be any of silver chloride, silver bromide, silver iodobromide, silver chlorobromide, silver chloroiodide and silver chloroiodobromide.

The silver halide emulsion used in the present invention may be a surface latent image type emulsion or an internal latent image type emulsion. The internal latent image type emulsion may be used as a direct reversal emulsion in combination with a nucleating agent or a light fogging agent. Alternatively, the silver halide emulsion may be a core/shell emulsion in which the interior and the surface of the grain are different from each other in phase. The silver halide emulsion may be a monodisperse or polydisperse emulsion or a mixture thereof. The grain size of the emulsion is preferably in the range of from 0.1 to 2 μm, particularly from 0.2 to 1.5 μm. The crystal habit of the silver halide grains may be cubic, octahedral, tetradecahedral or tabular with a high aspect ratio.

In particular, silver halide emulsions as described in U.S. Pat. Nos. 4,500,626 and 4,628,021, *Research Disclosure,* No. 17029 (1978), and JP-A-62-253159 may be used in the present invention.

The silver halide emulsion may be used unripened but is normally used after being chemically sensitized. For emulsions for the light-sensitive materials, known sulfur sensitization processes, reduction sensitization processes and noble metal sensitization processes may be used singly or in combination. These chemical sensitization processes may be optionally effected in the presence of a nitrogen-containing heterocyclic compound as disclosed in JP-A-62-253159.

The amount of the light-sensitive silver halide emulsion coated is in the range of from 1 mg to 10 g/m$^2$ (calculated in terms of amount of silver).

The silver halide used in the present invention may be conventionally spectrally sensitized with a methine dye or the like. Examples of such dyes include cyanine dyes, merocyanine dyes, complex cyanine dyes, complex merocyanine dyes, holopolar cyanine dyes, hemicyanine dyes, styryl dyes and hemioxonol dyes.

Specific examples of dyes include sensitizing dyes as described in U.S. Pat. No. 4,617,257, JP-A-59-180550, JP-60-140335, and *Research Disclosure,* No. 17029 (1978), pp. 12–13.

These sensitizing dyes may be used singly or in combination. In particular, combinations of sensitizing dyes are often used for the purpose of supersensitization.

The light-sensitive silver halide emulsion may comprise a dye which does not exhibit a spectral sensitizing effect by itself or a compound which does not substantially absorb visible light but exhibits a supersensitizing effect (as described in U.S. Pat. No. 3,615,641 and JP-A-63-23145) together with such a sensitizing dye.

Such sensitizing dyes may be incorporated in the emulsion during, before or after chemical sensitization. Alternatively, the sensitizing dye may be incorporated in the emulsion before or after the nucleation of silver halide grains as described in U.S. Pat. Nos. 4,183,756 and 4,225,666. The amount of sensitizing dye incorporated is normally in the range of from $10^{-8}$ to $10^{-2}$ mol per mol of light-sensitive silver halide.

In the present invention, organometallic salts may be used as oxidizing agents in combination with the light-sensitive silver halide. Among such organometallic salts, organic silver salts are particularly preferably used.

Examples of organic compounds which can be used to form such an organic silver salt oxidizing agent include benzotriazoles, fatty acids, and other compounds as described in U.S. Pat. No. 4,500,626 (52nd column to 53rd column). Other useful examples of such organic compounds include carboxylic acid silver salts containing an alkynyl group such as silver phenylpropiolate as described in JP-A-60-113235, and silver acetylide as described in JP-A-61-249044. These organic silver salts may be used in combination.

These organic silver salts are generally used in an amount of from 0.01 to 10 mols, preferably from 0.01 to 1 mol, per mol of light-sensitive silver halide. The total amount of light-sensitive silver salt and organic silver salt coated is preferably in the range of from 50 mg to 10 g/m$^2$ (calculated in terms of amount of silver).

In the present invention, various fog inhibitors or photographic stabilizers may be used. Examples of such fog inhibitors or photographic stabilizers include azoles or azaindenes as described in *Research Disclosure,* No. 17643 (1978), pp. 24–25, nitrogen-containing carboxylic acids or phosphoric acids as described in JP-A-59-168442, mercapto compounds and metal salts thereof as described in JP-A-59-111636, and acetylenic compounds as described in JP-A-62-87957.

As suitable reducing agents for the present invention there may be used conventional reducing agents known in the field of heat developable light-sensitive materials. Further, a reducing agent precursor which does not exhibit a reducing effect but undergoes reaction with a nucleophilic reagent or under heating to exhibit a reducing effect may be used in the present invention.

Examples of reducing agents used in the present invention include reducing agents or reducing agent precursors as described in U.S. Pat. Nos. 4,500,626 (49th column to 50th column), 4,483,914 (30th column to 31st column), 4,330,617, and 4,590,152, JP-A-60-140335, JP-A-57-40245, JP-A-56-138736, JP-A-59-178458, JP-A-59-53831, JP-A-59-182449, JP-A-59-182450, JP-A-60-119555, JP-A-60-128436, JP-A-60-128437, JP-A-60-128438, JP-A-60-128439, JP-60-198540, JP-A-60-181742, JP-A-61-259253, JP-A-62-244044, JP-A-62-131253, JP-A-62-131254, JP-A-62-131255, and JP-A-62-131256, and European Pat. No 220,746A2 (pp. 78–96).

Combinations of various reducing agents as disclosed in U.S. Pat. No. 3,039,869 may also be used in the present invention.

It is preferred that combinations of electron donors with electron transfer agents (ETA) are used as reducing agents in the present invention. These compounds are illustrated in more detail in European Pat. No. 220,746A2 and *Kokai Giho* 87-6199. Particularly preferred examples of the electron donors (or precursors) include compounds represented by the following formulas (C) and (D):

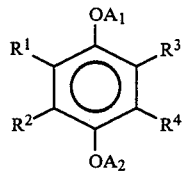

(C)

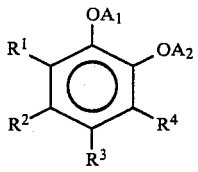

(D)

wherein $A^1$ and $A^2$ each represents hydrogen atom or a phenolic hydroxyl group as protective group which can be protected from elimination by a nucleophilic reagent.

Examples of such nucleophilic reagents include anionic reagents such as $OH^-$, $RO^-$ (in which R represents an alkyl or aryl group), hydroxamic acid anions, and $SO_3^{2-}$, and compounds having nonpaired electrons such as primary or secondary amines, hydrazine, hydroxylamines, alcohols, and thiols. Preferred examples of $A^1$ and $A^2$ include hydrogen atom, acyl group, alkylsulfonyl group, arylsulfonyl group, alkoxycarbonyl group, aryloxycarbonyl group, dialkylphosphoryl group, diarylphosphoryl group, and protective groups as described in JP-A-59-197037 and Jp-A-59-20105. $A^1$ and $A^2$ may be connected to $R^1$, $R^2$, $R^3$ and $R^4$ to form a ring if possible. $A^1$ and $A^2$ may be the same or different.

$R^1$, $R^2$, $R^3$ and $R^4$ each represents hydrogen atom or an alkyl group (e.g., an alkyl group which may be substituted, such as methyl group, ethyl group, n-butyl group, cyclohexyl group, n-octyl group, allyl group, secoctyl group, tert-octyl group, n-dodecyl group, n-pentadecyl group, n-hexadecyl group, tert-octadecyl group, 3-hexadecanoylaminophenylmethyl group, 4-hexadecylsulfonylaminophenylmethyl group, 2-ethoxycarbonylethyl group, 3-carboxypropyl group, N-ethylhexadecylsulfonylaminomethyl group, N-methyldodecylsulfonylaminoethyl group), aryl group (e.g., an aryl group which may be substituted, such as phenyl group, 3-hexadecyloxyphenyl group, 3-methoxyphenyl group, 3-sulfophenyl group, 3-chlorophenyl group, 2-carboxyphenyl group, 3-dodecanoylaminophenyl group), alkylthio group (e.g., an alkylthio group which may be substituted, such as n-butylthio group, methylthio group, tert-octylthio group, n-dodecylthio group, 2-hydroxyethylthio group, n-hexadecylthio group, 3-ethoxycarbonylpropiothio group), arylthio group (e.g., an arylthio group which may be substituted, such as phenylthio group, 4-chlorophenylthio group, 2-n-octyloxy-5-t-butylphenylthio group, 4-dodecyloxyphenylthio group, 4-hexadecanonylaminophenylthio group), sulfonyl group (e.g., an aryl or alkylsulfonyl group which may be substituted, such as methanesulfonyl group, butanesulfonyl group, p-toluenesulfonyl group, 4-dodecyloxyphenylsulfonyl group, 4-acetylaminophenylsulfonyl group), sulfo group, halogen atom (e.g., fluorine, chlorine, bromine, iodine), cyano group, carbamoyl group (e.g., a carbamoyl group which may be substituted, such as methylcarbamoyl group, diethylcarbamoyl group, 3-(2,4-di-t-pentylphenyloxy)propylcarbamoyl group, cyclohexylcarbamoyl group, di-n-octylcarbamoyl group), sulfamoyl group (e.g., a sulfamoyl group which may be substituted, such as diethylsulfamoyl group, di-n-octylsulfamoyl group, n-hexadecylsulfamoyl group, 3-isohexadecanoylaminophenylsulfamoyl group), amido group (e.g., an amido group which may be substituted, such as acetamido group, isobutyloylamino group, 4-tetradecyloxyphenylbenzamido group, 3-hexadecanoylaminobenzamido group), imido group (e.g., an imido group which may be substituted, such as succinimido group, 3-laurylsuccinimido group, phthalimido group), carboxyl group, and sulfonamido group (e.g., a sulfonamido group which may be substituted, such as methanesulfonamido group, octanesulfonamido group, hexadecanesulfonamido group, benzenesulfonamido group, toluenesulfonamido group, 4-lauryloxybenzenesulfonamido group).

The total number of carbon atoms contained in $R^1$ to $R^4$ is 8 or more. In the general formula (C), $R^1$ and $R^2$ and/or $R^3$ and $R^4$ may be connected to each other to form a saturated or unsaturated ring. In the general formula (D) $R^1$ and $R^2$, $R^2$ and $R^3$ and/or $R^3$ and $R^4$ may be connected to each other to form a saturated or unsaturated ring.

Preferred among electron donors represented by the general formula (C) or (D) is an electron donor wherein at least two of $R^1$ to $R^4$ are substituents other than hydrogen atom. A particularly preferred compound is an electron donor wherein at least one Of $R^1$ and $R^2$ is a substituent other than hydrogen atom and at least one of $R^3$ and $R^4$ is a substituent other than hydrogen atom.

A plurality of electron donors may be used in combination. Alternatively, electron donors may be used in combination with their precursors. The electron donor may be the same compound as the reducing substance of the present invention.

Specific examples of electron donors will be shown hereinafter, but the present invention should not be construed as being limited thereto.

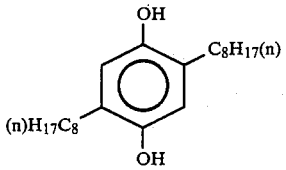

(ED-1)

-continued
(ED-2)
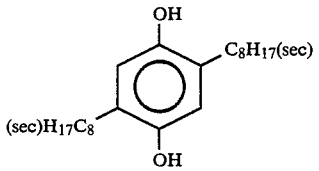
(ED-3)
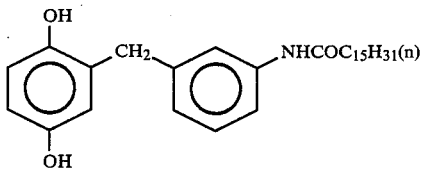
(ED-4)
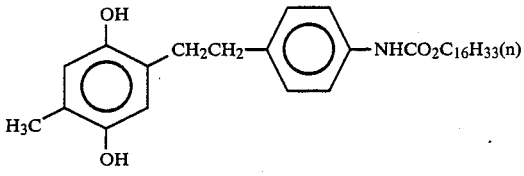
(ED-5)
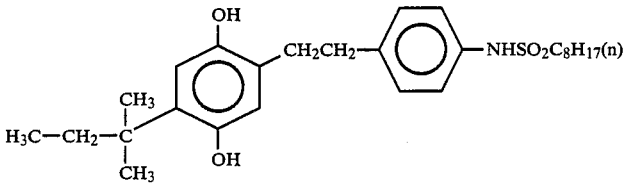
(ED-6)
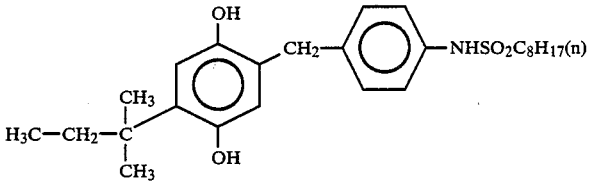
(ED-7)
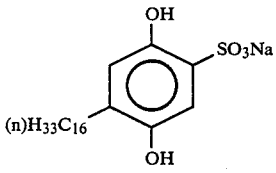
(ED-8)
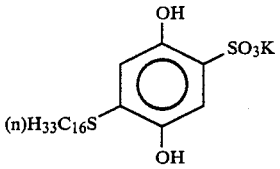
(ED-9)
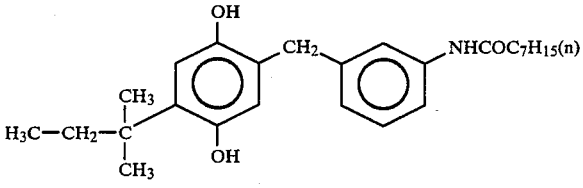

-continued (ED-10)

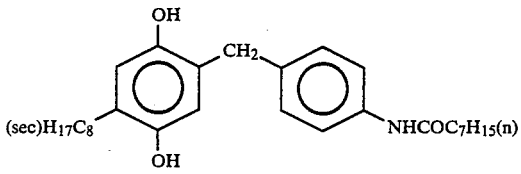

(ED-11)

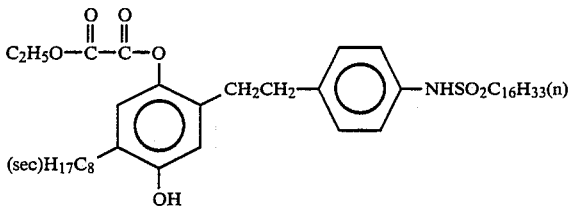

(ED-12)

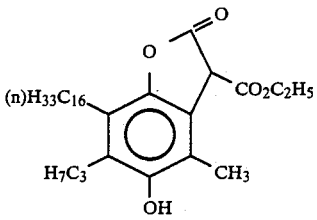

The amount of the electron donor (or its precursor) used can vary widely. Preferably, the amount used is in the range of 0.01 to 50 mols, particularly 0.1 to 5 mols, per mol of positive dye-providing substance and of 0.001 to 5 mols, preferably 0.01 to 1.5 mols, per mol of silver halide, respectively.

Regarding the ETA for use in combination with these electron donors, any compound which undergoes oxidation by silver halide to give an oxidation product which is capable of cross-oxidizing these electron donors may be used. Mobile compounds may be preferably used.

A particularly preferred ETA compound is represented by the general formula (X-I) or (X-II):

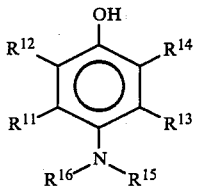

[X-I]

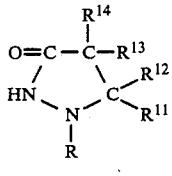

[X-II]

wherein R represents an aryl group; and $R^{11}$, $R^{12}$, $R^{13}$, $R^{14}$, $R^{15}$ and $R^{16}$ may be the same or different and each represents hydrogen atom, a halogen atom, an acylamino group, an alkoxy group, an alkylthio group, an alkyl group or an aryl group.

Examples of aryl groups represented by R in the general formula (X-II) include phenyl group, naphthyl group, tolyl group and xylyl group. These groups may be substituted by a halogen atom (e.g., chlorine, bromine), an amino group, an alkoxy group, an aryloxy group, hydroxyl group, an aryl group, a carbonamido group, a sulfonamido group, an alkanoyloxy group, a benzoyloxy group, a ureido group, a carbamate group, a carbamoyloxy group, a carbanate group, a carboxyl group, a sulfo group, or an alkyl group (e.g., methyl group, ethyl group, propyl group).

The alkyl group represented by $R^{11}$, $R^{12}$, $R^{13}$, $R^{14}$, $R^{15}$ and $R^{16}$ in the general formulas (X-I) and (X-II) is a $C_{1-10}$ alkyl group such as methyl group, ethyl group, propyl group, and butyl group. These alkyl groups may be substituted by hydroxyl group, an amino group, a sulfo group, or a carbonyl group. As the suitable aryl groups for use in the present invention include phenyl group, naphthyl group, xylyl group, and tolyl group. These aryl groups may be substituted by a halogen atom (e.g., chlorine, bromine), an alkyl group (e.g., methyl group, ethyl group, propyl group), a hydroxyl group, an alkoxy group (e.g., methoxy group, ethoxy group), a sulfo group, or a carboxyl group. In the present invention, a compound represented by the general formula (X-II) is particularly preferred. Preferably, in the general formula (X-II), $R^{11}$, $R^{12}$, $R^{13}$, and $R^{14}$ each represents hydrogen atom, a $C_{1-10}$ alkyl group, a $C_{1-10}$ substituted alkyl group, or a substituted or unsubstituted aryl group. More preferably, $R^{11}$, $R^{12}$, $R^{13}$, and $R^{14}$ each represents hydrogen atom, methyl group, hydroxymethyl group, phenyl group, or a phenyl group substituted by a hydrophilic group such as a hydroxyl group, an alkoxy group, a sulfo group, and a carboxyl group.

Specific examples of compounds represented by the general formula (X-II) will be shown hereinafter.

(X-1)

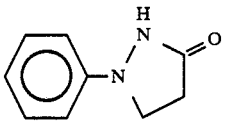

-continued (X-2)

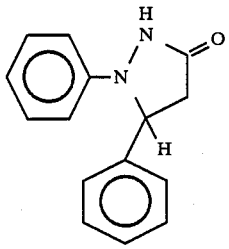

(X-3)

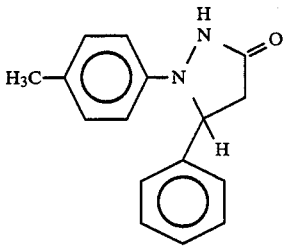

(X-4)

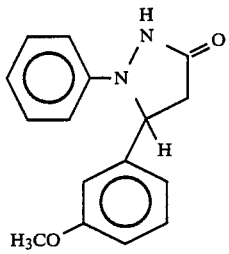

(X-5)

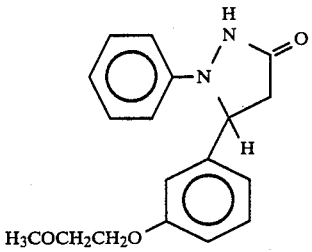

(X-6)

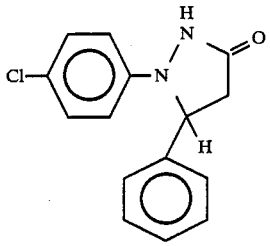

(X-7)

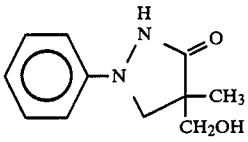

(X-8)

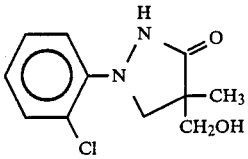

-continued (X-9)

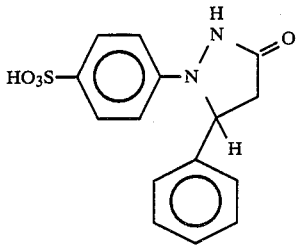

(X-10)

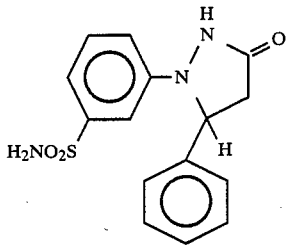

The ETA precursor for use in the present invention is a compound which has no developing effect during storage of the light-sensitive material prior to its use but releases ETA only when acted upon by a proper activator such as a base or nucleophilic agent, or heating.

Particularly, the ETA precursor for use in the present invention doesn't serve as ETA before development because its reactive functional group is blocked by a blocking group. The ETA precursor can serve as ETA only when subjected to an alkaline condition or heated so that the blocking group cleaves. Examples of ETA precursors which can be used in the present invention include 2- or 4-acyl derivatives or 2-aminoalkyl or hydroxylalkyl derivatives of 1-phenyl-3-pyrazolidinone, hydroquinone, metallic salts of catechol (e.g., lead, cadmium, calcium, or barium salts), halogenated acyl derivatives of hydroquinone, oxazine or bisoxazine derivatives of hydroquinone, lactone type ETA precursors, hydroquinone derivatives containing a quaternary ammonium group, cyclohexakis-2-en-1,4-dione type compounds, compounds which undergo electron transfer reaction to release ETA, compounds which undergo intramolecular nucleophilic displacement reaction to release ETA, ETA precursors blocked by phthalido group, and ETA precursors blocked by indomethyl group.

ETA precursors for use in the present invention include known compounds. Suitable known ETA precursor compounds include the developing agent precursors described in U.S. Pat. Nos. 3,241,967, 3,246,988, 3,295,978, 3,462,266, 3,586,506, 3,615,439, 3,650,749, 4,209,580, 4,330,617, and 4,310,612, British Pat. Nos. 1,023,701, 1,231,830, 1,258,924, and 1,346,920, JP-A-57-40245, JP-A58-1139, JP-A-58-1140, JP-A-59-178458, JP-A-59-182449, and JP-A-59-182450.

Particularly preferred among these compounds are precursors of 1-phenyl-3-pyrazolidinones as described in JP-A-59-178458, JP-A-59-182449, and JP-A-59-182450.

It is preferred that the combination of an electron donor with an ETA be incorporated in the heat developable color light-sensitive material of the present invention. A combination of two or more electron donors with two or more ETA or precursors can be used in the present invention. The combination may be added to each of the emulsion layer (e.g., blue-sensitive layer, green-sensitive layer, red-sensitive layer, infrared-sensitive layer, ultraviolet light-sensitive layer, etc.) of the light-sensitive material. The combination may be added to one or more emulsion layers, or layers (e.g., anti-halation layer, subbing layer, interlayer, protective layer) adjacent to the emulsion layers. If desired, the combination may be added to all layers. The electron donor and ETA can be added to the same layer, or can be individually added to separate layers.

The reducing agent and the dye providing substance can be added to the same layer, or can be individually added to separate layers. However, it is preferred that the electron donor and the dye providing substance be added to the same layer from the viewpoint of non-diffusion.

ETA may be incorporated in an image-receiving material (dye fixing layer). When a small amount of water is present during heat development, ETA may be dissolved in the water. The electron donor and ETA or its precursor are used in an amount of 0.01 to 50 mols in total, preferably 0.1 to 5 mols in total, per mol of the dye providing substance. The electron donor and ETA or its precursor are used in an amount of 0.001 to 5 mols in total, preferably 0.01 to 1.5 mols in total, per mol of silver halide.

ETA is used in an amount of not more than 60 mol%, preferably not more than 40 mol%, of the total mols of reducing agent. When ETA is dissolved in water, the concentration of ETA is preferably in the range of from $10^{-4}$ mol/l to 1 mol/l.

The dye providing compounds used in the present invention can be represented by the following general formula (LI):

$$(\text{Dye}-\text{Y})_n-\text{Z} \qquad \text{(LI)}$$

wherein Dye represents a dye group, a dye group which has been temporarily shifted to a short wavelength range or a dye precursor group; Y represents a mere bond or connecting group; Z represents a group which makes a difference in the diffusibility of the compound represented by $(\text{Dye}-\text{Y})_n-\text{Z}$ in corresponding or counter-corresponding to light-sensitive silver salts having a latent image distributed imagewise or releases Dye in corresponding or counter-corresponding to light-sensitive silver salts having a latent image distributed imagewise to make no difference in the diffusibility between Dye thus released and $(\text{Dye}-\text{Y})_n-\text{Z}$; and n represents an integer of 1 or 2. If n is 2, two (Dye—Y)'s may be the same or different.

Specific examples of the dye providing compound represented by the general formula (LI) include the following compounds i to iii.

i. Dye developing agents comprising a hydroquinone developing agent connected to a dye component as described in U.S. Pat. Nos. 3,134,764, 3,362,819, 3,597,200, 3,544,545, and 3,482,972. These dye developing agents are diffusible in alkaline conditions but become nondiffusible upon reaction with silver halide.

ii. Non-diffusible compounds which release a diffusible dye in alkaline conditions but lose their function upon reaction with silver halide as described in U.S. Pat. No. 4,503,137. Examples of such compounds include compounds which undergo intramolecular nucleophilic displacement reactions to release a diffusible dye as described in U.S. Pat. No. 3,980,479, and compounds which undergo an intramolecular rewinding reaction of the isooxazolone ring to release a diffusible dye as described in U.S. Pat. No. 4,199,354.

iii. Non-diffusible compounds that react with a reducing agent left unoxidized after being developed to release a diffusible dye as described in U.S. Pat. No. 4,559,290, European Pat. No. 220,746A2, and *Kokai Giho* 87-6,199.

Examples of such compounds include compounds which undergo intramolecular nucleophilic displacement reaction after being reduced to release a diffusible dye as described in U.S. Pat. Nos. 4,139,389 and 4,139,379, and JP-A-59-185333, and JP-A-57-84453, compounds which undergo an intramolecular electron transfer reaction after being reduced to release a diffusible dye as described in U.S. Pat. No. 4,232,107, JP-A-59-101649, JP-A-61-88257, and *Research Disclosure,* No. 24,025 (1984), compounds which undergo cleavage of a single bond after being reduced to release a diffusible dye as described in West German Pat. 3,008,588A, JP-A-56-142530, and U.S. Pat. Nos. 4,343,893, and 4,619,884, nitro compounds which receive electrons to release a diffusible dye as described in U.S. Pat. No. 4,450,223, and compounds which receive electrons to release a diffusible dye as described in U.S. Pat. No. 4,609,610.

Preferred examples of such compounds include compounds containing an N—X bond (wherein X represents oxygen atom, sulfur atom or nitrogen atom) and an electrophilic group in one molecule as described in European Pat. 220,746A2, *Kokai Giho* 87-6,199, JP-A-63-201653, and JP-A-63-201654, compounds containing an $SO_2$—X group (wherein X is as defined above) and an electrophilic group in one molecule as described in U.S. Application SN 07/188,779, compounds containing a PO—X bond (wherein X is as defined above) and an electrophilic group in one molecule as described in JP-A-63-271344, and compounds containing a C—X' bond (wherein X' is as defined above for X or represents —$SO_2$—) and an electrophilic group in one molecule as described in JP-A-63-271341.

Particularly preferred among these compounds are compounds containing an N—X bond and an electrophilic group in one molecule. Specific examples of such compounds include Compounds (1) to (3), (7) to (10), (12), (13), (15), (23) to (26), (31), (32), (35), (36), (40), (41), (44), (53) to (59), (64), and (70) described in European Pat. No. 220,746A2, and Compounds (11) to (23) described in *Kokai Giho* 87-6,199.

Typical examples of the dye providing compounds which can be used in the present invention include the following compounds.

(1)
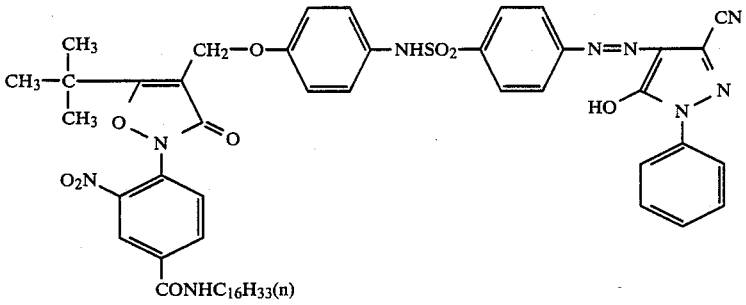
(2)
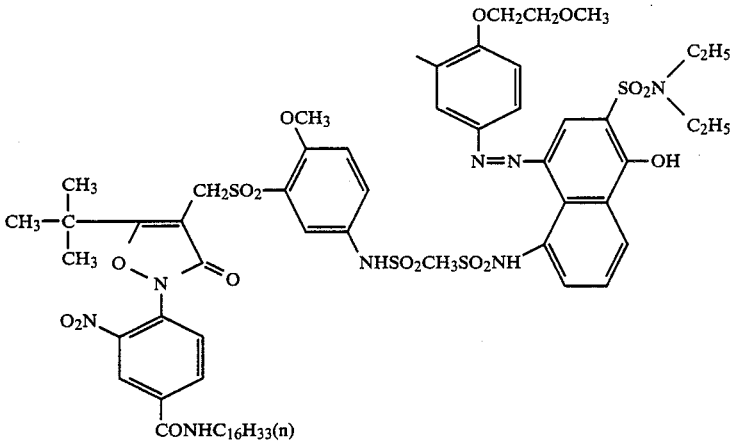
(3)
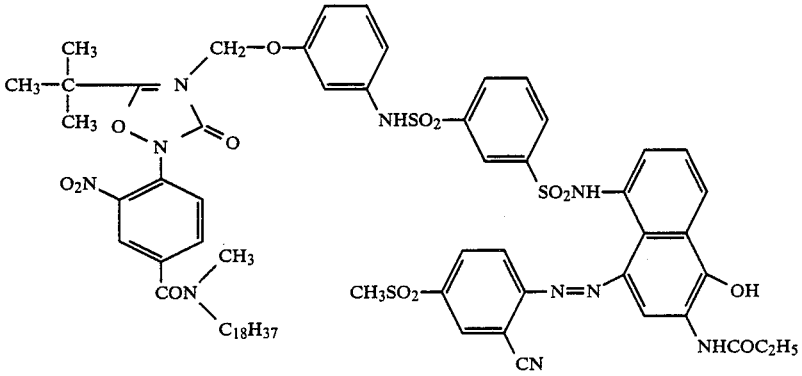
(4)
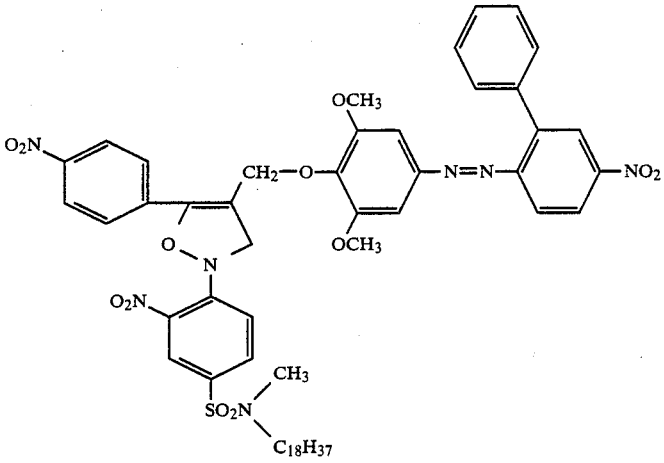

-continued
(5)
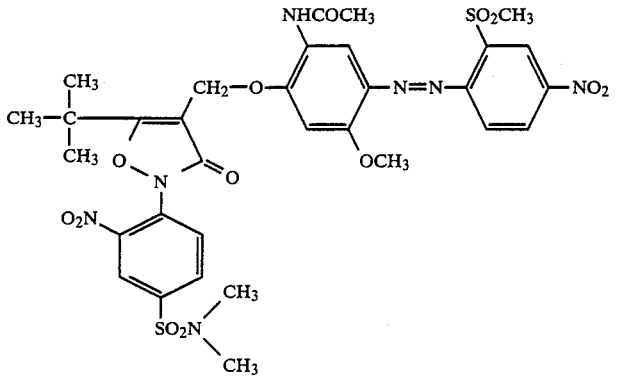
(6)
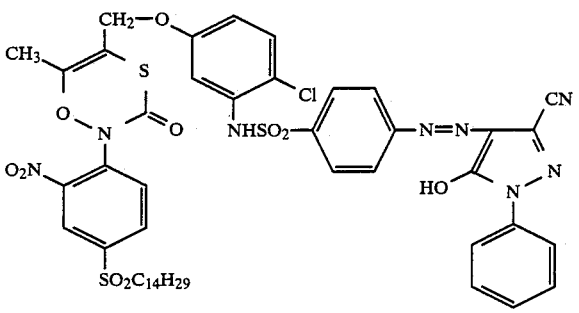
(7)
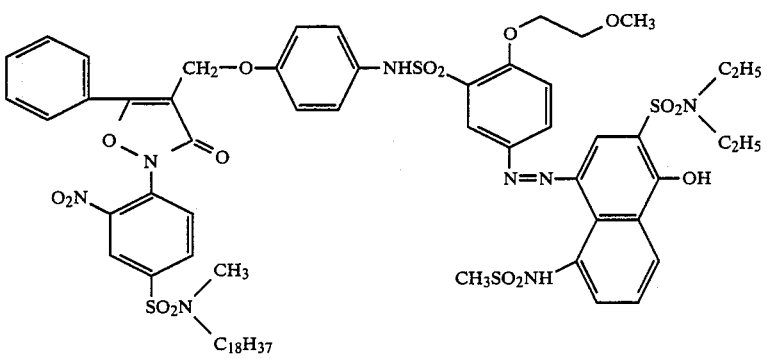
(8)
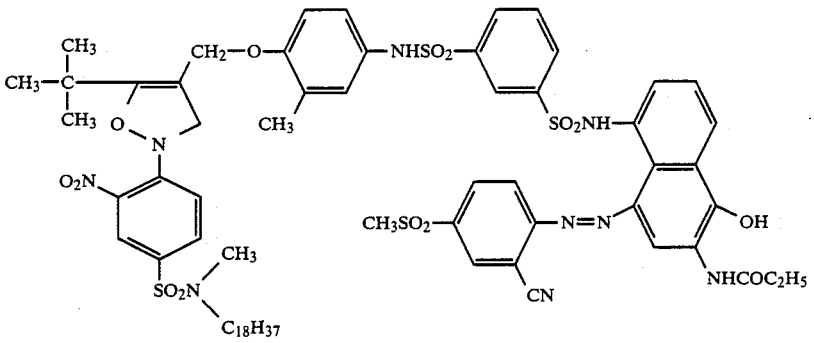

-continued
(9)
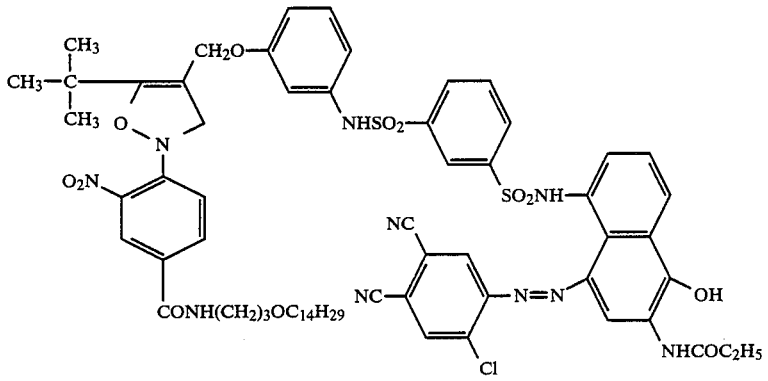
(10)
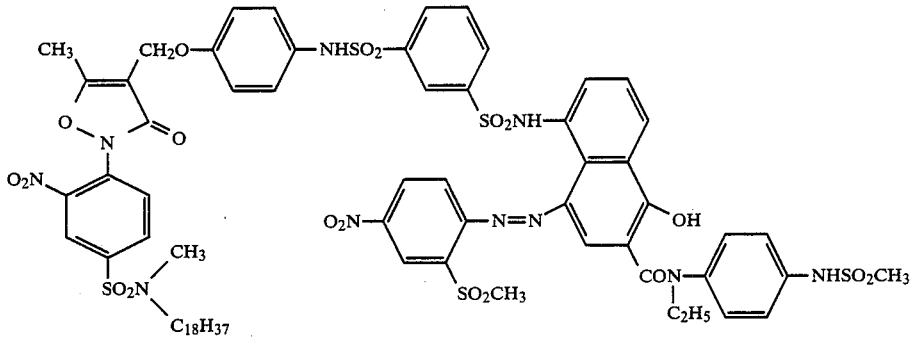
(11)
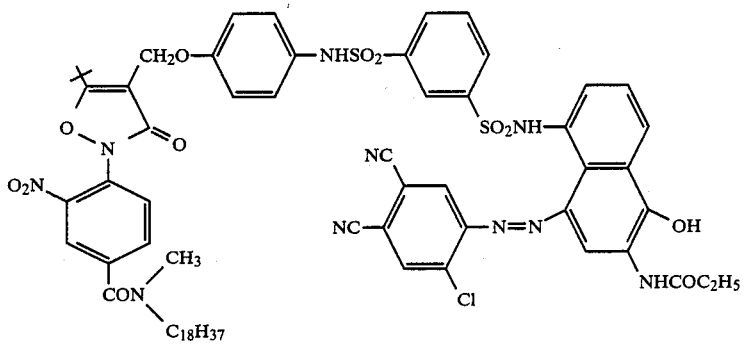
(12)
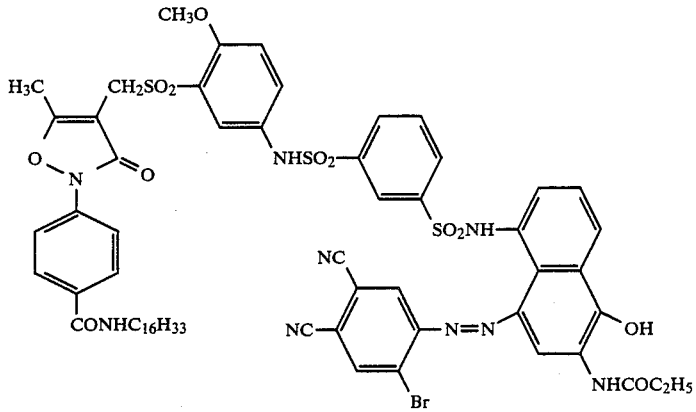

-continued (13)

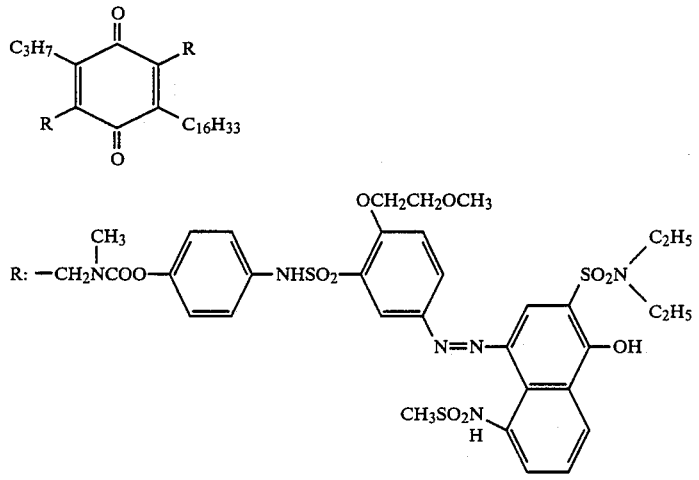

(14)

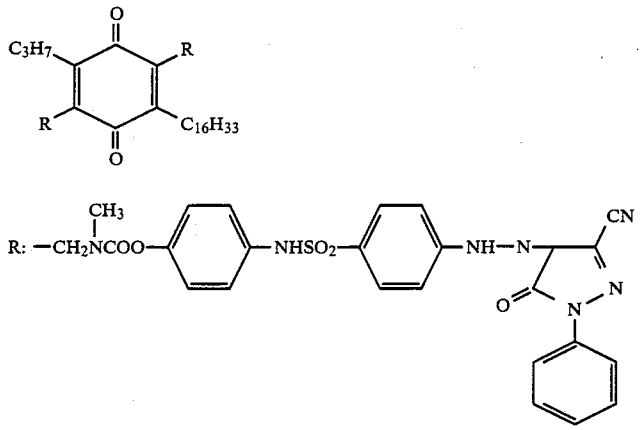

(15)

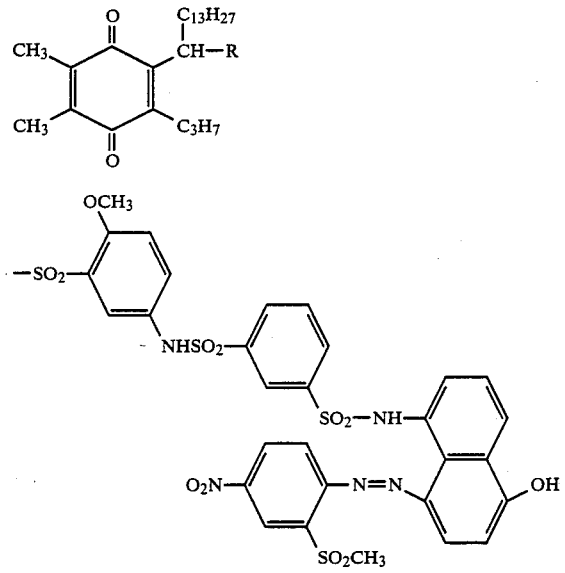

The incorporation of a hydrophobic additive such as a dye providing compound or a non-diffusible reducing agent in a layer of light-sensitive material can be accomplished by any known method as described in U.S. Pat. No. 2,322,027. In this case, a high boiling organic solvent as described in JP-A-59-83154, JP-A-59-178451, JP-A-59-17852, JP-A-59-178453, JP-A-59-178454, JP-A-59-178455, and JP-A-59-178457 may optionally be used in combination with a low boiling organic solvent having a boiling point of from 50 to 160° C.

The amount of such a high boiling organic solvent incorporated is generally in the range of from 1 to 10 g, preferably 5 g or less, per gram of dye-providing compound used or 1 cc or less, preferably 0.5 cc or less, particularly preferably 0.3 cc or less, per gram of binder.

A dispersion process as described in JP-B-51-39853 and JP-A-51-59943 which comprises using a polymerization product may also be used. (The term "JP-B" as used herein means an "examined Japanese patent publication".)

If a compound which is substantially insoluble in water is used, it may be incorporated in the binder in the form of dispersion of finely divided particles rather than by the above described processes.

In order to disperse a hydrophobic compound in a hydrophilic colloid, various surface active agents can be used. Examples of such surface active agents which may be used in this dispersion process include those described as surface active agent in JP-A-59-157636 (pp. 37–38).

In the present invention, a compound which serves both to accelerate the development of photosensitive materials and stabilize images may be used. Specific examples of such compounds preferably used in the present invention are described in U.S. Pat. No. 4,500,626 (51st column to 52nd column).

In a system where the diffusion transfer of a dye(s) is used to form images, a dye fixing material is used in combination with the light-sensitive material. Such a dye fixing material may be either coated on a separate support from the light-sensitive material or coated on the same support as the light-sensitive material. For the relationship of the light-sensitive material with the dye fixing material, the support and a white reflecting layer which can be used, those described in U.S. Pat. No. 4,500,626 (57th column) are useful.

The dye fixing material preferably used in the present invention may comprise at least one layer containing a mordant and a binder. As such mordants there may be used those known in the field of photography. Specific examples of such mordants include those described in U.S. Pat. No. 4,500,626 (58th column to 59th column), JP-A-61-88256 (pp. 32–41), JP-A-62-244043 and JP-A-62-244036. Alternatively, a dye-receiving high molecular weight compound as described in U.S. Pat. No. 4,463,079 may be used.

The dye fixing material may optionally comprise auxiliary layers such as a protective layer, strippable layer or anti-curling layer. Particularly, a protective layer can be advantageously incorporated in the dye fixing material.

As suitable binders incorporated in the light-sensitive material or dye fixing material there may be used a hydrophilic binder. Examples of such hydrophilic binders include those described in JP-A-62-253159 (pp. 26–28). Specific examples of such hydrophilic binder include transparent or semi-transparent hydrophilic binders such as proteins (e.g., gelatin, gelatin derivative), polysaccharides (e.g., cellulose derivatives, starch, gum arabic, dextran, pullulan), and synthetic high molecular compounds (e.g., polyvinyl alcohol, polyvinylpyrrolidone, acrylamide polymers). Alternatively, a high water-absorbing polymer as described in JP-A-62-245260, i.e., a homopolymer of a vinyl monomer containing —COOM or —$SO_3M$ (wherein M represents a hydrogen atom or alkali metal) or a copolymer of such vinyl monomers or such a vinyl monomer with other vinyl monomers (e.g., sodium methacrylate, ammonium methacrylate, SUMIKAGEL® L-5H made by Sumitomo Chemical Co., Ltd.) may be used. These binders may be used singly or in combination.

In a system wherein heat development is effected with a slight amount of water, the above described high water-absorbing polymer may be used to expedite the absorption of water. Such a high water-absorbing polymer may be incorporated in the dye fixing layer or in a protective layer therefor to prevent dye which has been transferred from being re-transferred from the dye fixing material to other materials.

In the present invention, the amount of the binder coated is preferably in the range of 20 g or less, more preferably 10 g or less, particularly 7 g or less per $m^2$.

Examples of film hardeners which may be incorporated in the constituent layers of the light-sensitive material or dye fixing material include those described in U.S. Pat. No. 4,678,739 (41st column), JP-A-59-116655, JP-A-62-245261, and JP-A-61-18942. Specific examples of such film hardeners include aldehyde film hardeners (e.g., formaldehyde), aziridene film hardeners, epoxy film hardeners (e.g.,

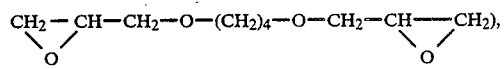

vinylsulfone film hardeners (e.g., N,N'-ethylenebis(vinylsulfonylacetamido)ethane), N-methylol film hardeners (e.g., dimethylol urea), and high molecular film hardeners (e.g., compounds as described in JP-A-62-234157), In the present invention, the light-sensitive material and/or dye fixing material may include an image formation accelerator. Such an image formation accelerator serves to accelerate a redox reaction between a silver salt oxidizing agent and a reducing agent, accelerate production or decomposition of a dye from a dye providing compound or release of a diffusible dye from the dye providing compound, or accelerate transfer of a dye from a light-sensitive material layer to a dye fixing layer. From the physicochemical standpoint, image formation accelerators can be classified into various groups such as base or base precursor, nucleophilic compound, high boiling organic solvent (oil), thermal solvent, surface active agent, and compounds capable of interacting with silver or silver ion. However, these groups normally have composite functions and therefore exhibit a combination of the above described accelerating effects. Details are given in U.S. Pat. No. 4,678,739 (38th column to 40th column).

Examples of such base precursors include salts of an organic acid capable of being heat-decarboxylated with a base, and compounds which undergo an intramolecular nucleophilic displacement reaction, Lossen rearrangement or Beckman rearrangement to release an amine. Specific examples of such base precursors are described in U.S. Pat. No. 4,511,493 and JP-A-62-65038.

In a system where heat development and dye transfer are simultaneously effected in the presence of a small amount of water, such a base and/base precursor may be preferably incorporated in the dye fixing material to improve the storage stability of the light-sensitive material.

Other examples of suitable base precursors include a combination of a sparingly soluble metallic compound and a compound capable of complexing with metal ions constituting said metallic compound as described in European Pat. No. 210,660A, and a compound as described in JP-A-61-232451 which undergoes electrolysis to produce a base. Particularly, the former compound may be effectively used. The sparingly soluble metallic compound and the complexing compound may advantageously be incorporated separately in the light-sensitive material and the dye fixing material.

The present light-sensitive material and/or dye fixing material may comprise various development stopping agents for the purpose of providing images resistant against fluctuations in temperature and time for development.

The term "development stopping agent" as used herein means a compound which readily neutralizes or reacts with a base to reduce the base concentration in the film to stopping development, or which interacts with silver or silver salt to inhibit development, after a proper development period. Specific examples of such compounds include acid precursors which release an acid on heating, electrophilic compounds which undergo a displacement reaction with a base present therewith on heating, and nitrogen-containing heterocyclic compounds, mercapto compounds and precursors thereof.

Details are given in JP-A-62-253159 (pp. 31–32).

The constituent layers (including the backing layer) of the light-sensitive material or dye fixing material may comprise various polymer latexes for the purpose of dimensional stability, inhibiting curling, adhesion, film cracking and pressure sensitization or desensitization or improving other film properties. Specific examples of suitable polymer latexes which may be used include those described in JP-A-62-245258, JP-A-62-136648, and JP-A-62-110066. In particular, if a polymer latex having a low glass transition point (40° C. or lower) is incorporated in the mordant layer, cracking of the mordant layer can be prevented. If a polymer latex having a high glass transition point is incorporated in the backing layer, an anticurling effect can be provided.

The constituent layers of the light-sensitive material or dye fixing material may comprise a high boiling organic solvent as a plasticizer, lubricant or agent for improving the strippability of the light-sensitive material from the dye fixing material. Specific examples of such a high boiling organic solvent include those described in JP-A-62-253159 (page 25) and JP-A-62-245253.

For the above described purposes, various silicone oils ranging from dimethyl silicone oil to modified silicone oil obtained by incorporating various organic groups into dimethylcycloxane may be used. For example, various modified silicone oils, particularly carboxy-modified silicone (trade name: X-22-3710), described at pp. 6–8 of "Modified Silicone Oil", technical data reported by Shin-Etsu Silicone Co., Ltd., may be effectively used.

Silicone oils as described in JP-A-62-215953 and JP-A-63-46449 may also be effectively used.

The light-sensitive material or dye fixing material may comprise a discoloration inhibitor. As such a discoloration inhibitor there may be used an antioxidant, ultraviolet absorber or certain kinds of metal complexes.

Examples of such an antioxidant include chroman compounds, coumaran compounds, phenol compounds (e.g., hindered phenols), hydroquinone derivatives, hindered amine derivatives, and spiroindane compounds. Other useful antioxidants include compounds as described in JP-A-61-159644.

Examples of suitable ultraviolet absorbers include benzotriazole compounds as described in U.S. Pat. No. 3,533,794, 4-thiazolidone compounds as described in U.S. Pat. No. 3,352,681, benzophenone compounds as described in JP-A-46-2784, and compounds as described in JP-A-54-48535, JP-A-62-136641, and JP-A-61-8256. Other useful ultraviole absorbers include ultraviolet-absorbing polymers as described in JP-A-62-260152.

Examples of suitable metal complexes include compounds as described in U.S. Pat. Nos. 4,241,155, 4,245,018, (3rd column to 36th column), and 4,254,195 (3rd column to 8th column), JP-A-62-174741, JP-A-61-88256 (pp. 27–29), and JP-A-63-199248.

Useful examples of other discoloration inhibitors are described in JP-A-62-215272 (pp. 125–137).

A discoloration inhibitor for inhibiting discoloration of a dye to be transferred to the dye fixing material may be previously incorporated in the dye fixing material or supplied into the dye fixing material from other materials such as light-sensitive material.

The above described antioxidants, ultraviolet absorbers and metal complexes may be used in combination.

The light-sensitive material or dye fixing material may comprise a fluorescent brightening agent. In particular, such a fluorescent brightening agent may be incorporated in the dye fixing material or supplied into the dye fixing material from other materials such as light-sensitive material. Examples of such fluorescent brightening agents include compounds as described in K. Veenkataraman, *The Chemistry of Synthetic Dyes,* Vol. V, Chapter 8, and JP-A-61-143752. Specific examples of such compounds include stilbene compounds, coumarin compounds, biphenyl compounds, benzoxazolyl compounds, naphthalimide compounds, pyrazoline compounds, and carbostyryl carboxy compounds.

Such a fluorescent brightening agent may be used in combination with a discoloration inhibitor.

The constituent layers of the light-sensitive material or dye fixing material may comprise various surface active agents for the purpose of aiding of coating, improving strippability and lubricity, inhibiting static electrification or accelerating development. Specific examples of such surface active agents are described in JP-A-62-173463 and JP-A-62-183457.

The constituent layers of the light-sensitive material or dye fixing material may comprise an organo-fluoro compound for the purpose of improving lubricity and strippability or inhibiting static electrification. Typical examples of such an organofluoro compound include fluorine surface active agents as described in JP-B-57-9053 (8th column to 17th column), JP-A-61-20944, and JP-A-62-135826, and hydrophobic fluorine compounds such as oily fluorine compounds (e.g., fluorine oil) or solid fluorine compound resins (e.g., tetrafluoroethylene resin).

The light-sensitive material or dye fixing material may comprise a matting agent. Examples of such a matting agent include compounds as described in JP-A-61-88256 (pp. 29) (e.g., silicon dioxide, polyolefin, polymethacrylate) and compounds as described in JP-A-63-279944 and JP-A-63-274952 (e.g., benzoguanamine resin beads, polycarbonate resin beads, AS resin beads).

Furthermore, the constituent layers of the light-sensitive material or dye fixing material may comprise a thermal solvent, an anti-foaming agent, an anti-bacterial and anti-fungal agent or colloidal silica. Specific examples of these additives are described in JP-A-61-88256 (pp. 26–32).

As a suitable support for the dye fixing material or light-sensitive material, there may be used a material capable of withstanding the processing temperature. In general, paper or a synthetic high molecular weight compound (film) may be used. Specific examples of such a support material which may be used in the present invention include polyethylene terephthalate, polycarbonates, polyvinyl chloride, polystyrene, polypropylene, polyimides or celluloses (e.g., triacetyl cellulose) or a material obtained by incorporating a pigment such as titanium oxide in such a film, a synthetic paper film formed of polypropylene or the like, a mixed paper made of synthetic resin pulp such as polyethylene and natural pulp, Yankee paper, baryta paper, coated paper (particularly cast coat paper), metals, fabrics, and glass.

Such a support material may be used as it is or in the form of a material laminated with a synthetic high molecular weight compound such as polyethylene on one or both sides thereof.

Alternatively, a support material as described in JP-A-62-253159 (pp. 29–31) may be used in the present invention.

These support materials may be coated with a hydrophilic binder, a semiconducting metal oxide such as alumina sol or tin oxide, carbon black or other antistatic agents.

Examples of process for exposing the light-sensitive material to light for imaging include processes which comprise using a camera to photograph scenery or persons, processes which comprise using a printer or enlarger to expose the light-sensitive material to light through a reversal film or negative film, processes which comprise using an exposing machine such as a copying machine to effect scanning exposure of the light-sensitive material to an original through a slit, processes which comprise exposing the light-sensitive material to light representative of image data emitted by a light emitting diode or various lasers, and processes which comprise exposing the light-sensitive material directly or through an optical system to light representative of image data emitted by an image display apparatus such as a CRT, liquid crystal display, electroluminescence display or plasma display.

As a light source for recording images on the light-sensitive material there may be used natural light, tungsten lamp, a light emitting diode, a laser, a CRT or light sources as described in U.S. Pat. No. 4,500,626 (56th column).

Furthermore, light of a wavelength where the wavelength of the light source has been modulated to, e.g., a half of wavelength with a non-linear optical element can also be used. In this case, it is possible to obtain easily light of a wavelength in the blue region which previously had been difficult to obtain with laser light or LED's.

Examples of image data which can be recorded on the present light-sensitive material include picture signals from a video camera, electron still camera or the like, a television signal according to Nippon Television Signal Code (NTSC), a picture signal obtained by dividing an original into many pixels by means of a scanner or the like, and a picture signal produced by means of a CG, CAD or like computer.

The heating temperature at the heat development is preferably in the range of from about 50° C. to about 250° C., particularly from about 80° C. to about 180° C. The dye diffusion transfer process may be effected simultaneously with or after heat development. In the latter case, the heating temperature at which dye transfer can be effected is preferably in the range of from the heating temperature for heat development to room temperature, particularly from 50° C. to a temperature about 10° C. lower than the heating temperature for heat development.

The transfer of a dye can be effected by heating alone. In order to accelerate the dye transfer, a solvent may be used.

Alternatively, a process as described in JP-A-59-218443 and JP-A-61-238056 which comprises heating the light-sensitive material in the presence of a small amount of a solvent, particularly water, to effect development and dye transfer simultaneously or in sequence may be effectively used. The heating temperature for this process is preferably in the range of from 50° C. to a temperature not higher than the boiling point of the solvent. For example, if the solvent is water, the heating temperature is preferably in the range of from 50° C. to 100° C.

Examples of a solvent which may be used to accelerate development and/or transfer of a diffusible dye to the dye fixing layer include water and a basic aqueous solution containing an inorganic alkali metal salt or organic base as described with reference to the image formation accelerators. Other useful examples of solvents include a low boiling solvent and a mixed solution made of such a low boiling solvent and water or a basic aqueous solution. Such a solvent may further comprise a surface active agent, fog inhibitor, sparingly soluble metal salt, complexing compound or the like.

These solvents may be incorporated in either or both of the light-sensitive material and the dye fixing material. The amount of the solvent incorporated in the light-sensitive material and/or dye fixing material may be small such as not more than the weight of the solvent in a volume corresponding to the maximum swelling volume of the total coated films (particularly, not more than the value obtained by subtracting the weight of the entire coated film(s) from the weight of the solvent in a volume corresponding to the maximum swelling volume of the entire coated film(s)) in the light-sensitive or dye fixing solvent.

As the process for incorporating the solvent in the light-sensitive layer or dye fixing layer, those described in JP-A-61-147244 (page 26) can be referenced. Alternatively, the solvent may be incorporated in either or both of the light-sensitive material and the dye fixing material in a microcapsule form or like form.

In order to accelerate transfer of a dye, a hydrophilic thermal solvent which stays solid at normal temperature but dissolves at an elevated temperature may be incorporated in the light-sensitive material or dye fixing material. Such a hydrophilic thermal solvent may be incorporated in either or both of the light-sensitive material and the dye fixing material. The layer in which the solvent is incorporated may be any one of emulsion layer, interlayer, protective layer and dye fixing layer, preferably the dye fixing layer and/or a layer adjacent thereto.

Examples of such a hydrophilic thermal solvent include ureas, pyridines, amides, sulfonamides, imides, anisoles, oximes and other heterocyclic compounds.

In order to accelerate the transfer of a dye, a high boiling organic solvent may be incorporated in the light-sensitive material and/or dye fixing material.

Examples of heating processes at development and/or the dye transfer step include processes which comprise bringing the light-sensitive material into contact with a heated block or plate, processes which comprise bringing the light-sensitive material into contact with a heating plate, hot presser, heat roller, halogen lamp heater, infrared or far infrared lamp heater or the like, and processes which comprises passing the light-sensitive material through a high temperature atmosphere. Alternatively, the light-sensitive material or dye fixing material may be provided with a resistive heating element layer so that it is heated by passing an electric current through the resistive heating element layer. As such a resistive heating element layer there may be used the one described in JP-A-61-145544.

As the pressure conditions and pressure application processes for the lamination of the light-sensitive material and the dye fixing material, those described in JP-A-61-147244 (p. 27) can be used.

For the photographic processing of the photographic material, any suitable heat developing apparatus may be employed.

Examples of such a heat developing apparatus preferably used in the present invention include those described in JP-A-59-75247, JP-A-59-177547, JP-A-59-181353, JP-A-60-18951, and JP-A-U-62-25944 (the term "JP-A-U" as used herein means an "unexamined published Japanese utility model application").

EXAMPLE 1

A light-sensitive material 101 having a structure given in the following Table 1 was prepared.

TABLE 1

| | | |
|---|---|---|
| Sixth layer Protective layer | | (g/m²) |
| Gelatin | | 0.091 |
| Matting agent (silica) | | 0.03 |
| Water-soluble polymer (1)* | | 0.23 |
| Surfactant (1)* | | 0.06 |
| Surfactant (2)* | | 0.13 |
| Hardening agent (1)* | | 0.01 |
| $ZnSO_4.7H_2O$ | | 0.06 |
| Fifth layer Blue-sensitive layer | | (g/m²) |
| Emulsion (1) | Amount of silver | 0.10 |
| Emulsion (2) | | 0.20 |
| Emulsion (3) | | 0.15 |
| Sensitizing dye (1)* | | $1.5 \times 10^{-3}$ |
| Gelatin | | 0.68 |
| Anti-fogging agent (1)* | | $1.36 \times 10^{-3}$ |
| Yellow dye providing substance (1)* | | 0.50 |
| High-boiling point organic solvent(1)* | | 0.50 |
| Electron donor (ED-6: earlier identified) | | 0.25 |
| Surfactant (3)* | | 0.05 |
| Electron transfer agent (X-2: earlier identified) | | 0.03 |
| Hardening agent (1)* | | 0.01 |
| Water-soluble polymer (2)* | | 0.02 |
| Fourth layer Interlayer | | (g/m²) |
| Gelatin | | 0.75 |
| $Zn(OH)_2$ | | 0.32 |
| Reducing agent (ED-6) | | 0.25 |
| High-boiling point organic solvent (1)* | | 0.13 |
| Surfactant (1)* | | 0.02 |
| Surfactant (4)* | | 0.07 |
| Water-soluble polymer (2)* | | 0.02 |
| Hardening agent (1)* | | 0.01 |
| Third layer Green-sensitive layer | | (g/m²) |
| Emulsion (4) | Amount of silver | 0.15 |
| Emulsion (5) | | 0.25 |
| Sensitizing dye (2)* | | $1.2 \times 10^{-3}$ |
| Gelatin | | 0.47 |
| Anti-fogging agent (1)* | | $1.25 \times 10^{-3}$ |
| Magenta dye providing substance (2) | | 0.37 |
| High-boiling point organic solvent (1)* | | 0.19 |
| Electron donor (ED-6) | | 0.14 |
| Surfactant (3)* | | 0.04 |
| Electron transfer agent (X-2) | | 0.03 |
| Hardening agent (1)* | | 0.01 |

TABLE 1-continued

| | | |
|---|---|---|
| Water-soluble polymer (2)* | | 0.02 |
| Second layer Interlayer | | (g/m²) |
| Gelatin | | 0.80 |
| $Zn(OH)_2$ | | 0.31 |
| Reducing agent (ED-6) | | 0.25 |
| High-boiling point organic solvent (1)* | | 0.13 |
| Surfactant (1)* | | 0.06 |
| Surfactant (4)* | | 0.10 |
| Water-soluble polymer (2)* | | 0.03 |
| Hardening agent (1)* | | 0.01 |
| First layer Red-sensitive layer | | (g/m²) |
| Emulsion (5) | Amount of silver | 0.20 |
| Emulsion (6) | | 0.15 |
| Sensitizing dye (3)* | | $7.0 \times 10^{-4}$ |
| Sensitizing dye (4)* | | $4.5 \times 10^{-4}$ |
| Gelatin | | 0.49 |
| Anti-fogging agent (1)* | | $1.25 \times 10^{-3}$ |
| Cyan dye providing substance (1) | | 0.37 |
| High-boiling point organic solvent (1)* | | 0.18 |
| Electron donor (ED-6) | | 0.14 |
| Surfactant (3)* | | 0.04 |
| Electron transfer agent (X-2) | | 0.03 |
| Hardening agent (1)* | | 0.01 |
| Water-soluble polymer (2)* | | 0.02 |
| Support (Polyethylene terephthalate of 100 μ in thickness | | |
| Backing layer | | (g/m²) |
| Carbon black | | 0.44 |
| Polyester | | 0.30 |
| Polyvinyl chloride | | 0.30 |

Water-soluble polymer (1)*
Sumikagel ® L-5 (H) Manufactured by Sumitomo Chemical Co., Ltd.
Water-soluble polymer (2)*

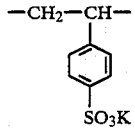

(molecular weight: about 800,000)

Surfactant (1)* Aerosol ® OT
Surfactant (2)*

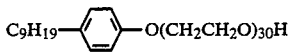

Surfactant (3)*

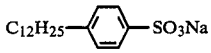

Surfactant (4)*

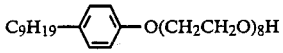

Hardening agent (1)*
1,2-bis(vinylsulfonylacetamido)ethane
High-boiling point organic solvent (1)*

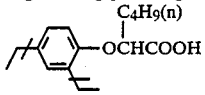

Anti-fogging agent (1)*

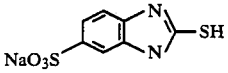

Sensitizing dye (1)*

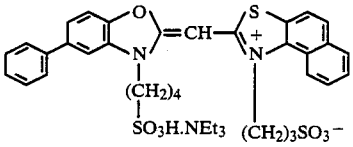

Sensitizing dye (2)*

TABLE 1-continued

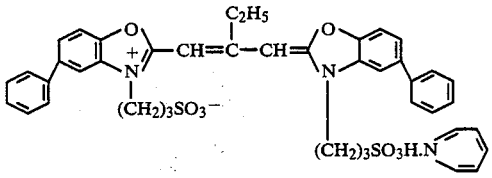

Sensitizing dye (3)*

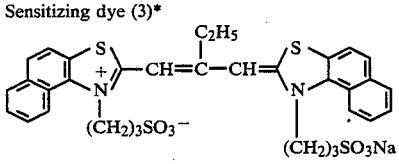

Sensitizing dye (4)*

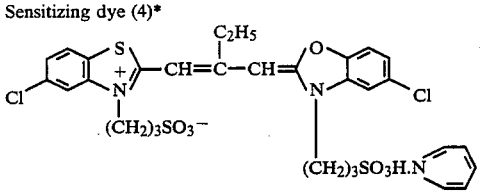

Emulsions were prepared in the following manner.

Emulsion (1)

To a well-stirred aqueous gelatin solution (30 g of gelatin, 0.5 g of potassium bromide and 1.5 g of $HO(CH_2)_2S(CH_2)_2S(CH_2)_2OH$ were added to 800 ml of water and the resulting solution was kept at 70° C.) were added the following solutions (I) and (II) simultaneously over a period of 15 minutes. Thereafter, the following solutions (III) and (IV) were added simultaneously thereto over a period of 30 minutes. The amounts of solutions (II) and (IV) added were adjusted to keep the pAg of the solution at 7.5. After water washing and desalting, 30 g of lime-processed ossein gelatin was added thereto to adjust the pH to 6.1 and the pAg to 8.3. Sodium thiosulfate, chloroauric acid and 4-hydroxy-6-methyl-1,3,3a,7-tetrazaindene were then added thereto to thereby effect the optimum chemical sensitization. In this way, there was obtained 600 g of a monodisperse cubic silver iodide emulsion (1) having a mean grain size of 0.80 μm.

| | Solution (I) (200 ml by addition of water) | Solution (II) (200 ml by addition of water) | Solution (III) (200 ml by addition of water) | Solution (IV) (200 ml by addition of water) |
|---|---|---|---|---|
| $AgNO_3$ (g) | 20 | — | 80 | — |
| KBr (g) | — | 13.9 | — | 53.2 |
| KI (g) | — | 0.2 | — | 3.9 |

Emulsion (2)

The procedure for the preparation of Emulsion (1) was repeated except that the temperature of the aqueous gelatin solution was 60° C. There was obtained 600 g of a monodisperse cubic silver iodobromide emulsion (2) having a mean grain size of 0.55 μm.

Emulsion (3)

The procedure of the preparation of Emulsion (1) was repeated except that the temperature of the aqueous gelatin solution was 50° C. There was obtained 600 g of a monodisperse cubic silver iodobromide emulsion (3) having mean grain size of 0.40 μm.

Emulsion (4)

To a well-stirred aqueous gelatin solution (the solution was composed of 600ml of water, 20 g of lime-processed ossein gelatin, 6 g of sodium chloride and 0.025 g of the following compound

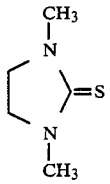

and the temperature thereof was kept at 75° C.) were added the following solutions (I) and (II) simultaneously over a period of 10 minutes. After the lapse of 10 minutes from the completion of the addition, the following solutions (III) and (IV) were added simultaneously thereto over a period of 30 minutes. After the solution was washed with water and desalted, 30 g of lime-processed gelatin was added thereto to a adjust the pH to 6.0 and the pAg to 7.8. Thereafter, triethylthiourea and 4-hydroxy-6-methyl-1,3,3a,7-tetrazaindene were added to the emulsion at 55° C. to thereby effect chemical sensitization. In this way, there was obtained 600 g of a monodisperse cubic silver chlorobromide emulsion (4) having a mean grain size of 0.71 μm.

| | Solution (I) (400 ml by addition of water) | Solution II) (400 ml by addition of water) | Solution (III) (400 ml by addition of water) | Solution (IV) (400 ml by addition of water) |
|---|---|---|---|---|
| $AgNO_3$ (g) | 10 | — | 90 | — |
| KBr (g) | — | 6.3 | — | 37.8 |
| KI (g) | — | 0.3 | — | 12.4 |

Emulsion (5)

The procedure for the preparation of Emulsion (4) was repeated except that the temperature of the aqueous gelatin solution was 60° C. There was obtained 600 g of a monodisperse cubic silver chlorobromide emulsion (5) having a mean grain size of 0.53 μm.

Emulsion (6)

The procedure for the preparation of Emulsion (4) was repeated except that the temperature of the aqueous gelatin solution was 50° C. and the following solutions (II) and (IV) having the following compositions were used in place of solutions (II) and (IV) for Emulsion (4). There was obtained 600 g of a monodisperse cubic silver chlorobromide emulsion (6) having a mean grain size of 0.36 μm.

| | Solution (II) (100 ml by addition of water) | Solution (IV) (100 ml by addition of water) |
|---|---|---|
| KBr (g) | 4.9 | 57.6 |
| NaCl (g) | 1.0 | 3.0 |
| KI (g) | — | 0.9 |

The preparation of the gelatin dispersion of the dye providing substance will now be illustrated.

13 g of yellow dye providing substance (1), 6.5 g of high-boiling point organic solvent (1) and 6.5 g of electron donor (ED-6) were dissolved in 37 ml of ethyl acetate. 10 g of a 10% gelatin solution and 60 ml of a 2.5% aqueous solution of sodium dodecylbenzenesulfonate were mixed with the foregoing solution with stirring. The mixture was dispersed in a homogenizer at 10,000 rpm for 10 minutes. The resulting dispersion is referred to as the dispersion of the yellow dye providing substance.

16.8 g of magenta dye providing substance (2), 8.4 g of high-boiling point organic solvent (1) and 6.3 g of electron donor (ED-6) were dissolved in 37 ml of ethyl acetate. 100 g of a 10% gelatin solution and 60 ml of a 2.5% aqueous solution of sodium dodecylbenzenesulfonate were mixed with the foregoing solution with stirring. The mixture was dispersed in a homogenizer at 10,000 rpm for 10 minutes. The resulting dispersion is referred to as the dispersion of the magenta dye providing substance.

15.4 g of cyan dye providing substance (11), 7.7 g of high-boiling point organic solvent (1) and 6.0 g of electron donor (ED-6) were dissolved in 37 ml of cyclohexanone. 100 g of a 10% gelatin solution and 60 ml of a 2.5% aqueous solution of sodium dodecylbenzenesulfonate were mixed with the foregoing solution with stirring. The mixture was dispersed in a homogenizer at 10,000 rpm for 10 minutes. The resulting dispersion is referred to as the dispersion of the cyan dye providing substance (1).

The preparation of the dye fixing material will now be illustrated.

The surface of a polyethylene-laminated paper support was coated with the following layers to prepare dye fixing material R-1.

TABLE 2

| | (g/m²) |
|---|---|
| Third layer | (g/m²) |
| Gelatin | 0.05 |
| Silicone oil *1 | 0.04 |
| Surfactant *2 | 0.001 |
| Surfactant *3 | 0.02 |
| Surfactant *4 | 0.10 |
| Picolinic acid guanidine | 0.90 |
| Polymer *5 | 0.24 |
| Second layer | |
| Mordant *6 | 2.35 |
| Polymer *7 | 0.60 |
| Gelatin | 1.40 |
| Polymer *5 | 0.21 |
| High-boiling point solvent *8 | 1.40 |
| Picolinic acid guanidine | 1.80 |
| Surfactant *2 | 0.02 |
| First layer | |
| Gelatin | 0.45 |
| Surfactant *4 | 0.01 |
| Polymer *5 | 0.04 |
| Hardening agent *9 | 0.30 |
| Polyethylene-laminated paper support (thickness: 170μ) | |
| First (or lower) backing layer** | |
| Gelatin | 3.25 |
| Hardening agent *9 | 0.25 |
| Second (upper) backing layer** | |
| Gelatin | 0.44 |
| Silicone oil *1 | 0.08 |
| Surfactant *2 | 0.002 |
| Matting agent *10 | 0.09 |

**Coated on the side opposite the first to third layers

Silicone oil *1

TABLE 2-continued (g/m²)

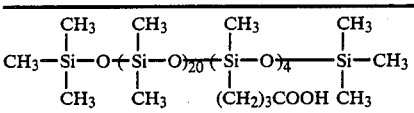

Surfactant *2 Aerosol ® OT

Surfactant *3

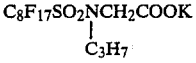

Surfactant *4

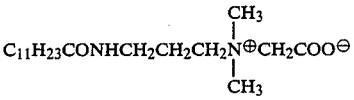

Polymer *5

Vinyl alcohol-sodium acrylate copolymer (75/25 molar ratio)

Polymer *7 Dextran (mw: 70,000)

Mordant *6

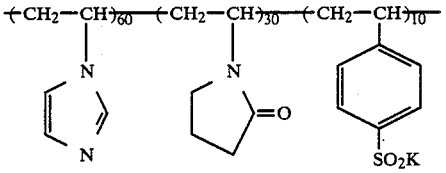

High-boiling organic solvent *8

Reofos ® manufactured by Ajinomoto Co., Inc.

Hardening agent *9

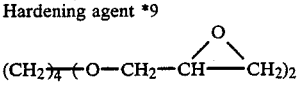

Matting agent *10

Benzoguanamine resin having particle size of greater than 10μ.

The procedure for the preparation of the light-sensitive material 101 was repeated except that each of the compounds given in Table 3 in an amount corresponding to 30 mol% of the dye providing substance was contained in the gelatin dispersion of each of the yellow, magenta and cyan dye providing substance to prepare each of light-sensitive materials 102 to 105, each having the same layer arrangement as that of the light-sensitive material 101.

The thus-obtained multi-layer light-sensitive materials 101 to 105 were exposed through B, G, R and gray color separation filters (density being continuously changed) at 5000 lux for 1/10 seconds using a tungsten lamp.

While each of the exposed light-sensitive materials was fed at a linear velocity of 20 mm/cc, water at a rate of 18 ml/m² was fed to the surface of the emulsion thereof by means of a wire bar coater and the film surface thereof and the image-receiving material were immediately put upon each other so as to be brought into intimate contact with each other.

The laminate was heated for 15 seconds using heated rollers whose temperature was controlled so that the temperature of the film which absorbed water became 85° C. The light-sensitive material was then peeled off from the image-receiving material. On the image-receiving material, there was obtained a clear blue, green, red and gray image corresponding to the B, G, R and gray color separation filters without forming unevenness.

The maximum density (Dmax) and minimum density (Dmin) of each of cyan, magenta and yellow colors in gray areas were measured. The results are shown in Table 3.

In another experiment, these light-sensitive materials were stored for 7 days under such conditions that the temperature was 45° C. and relative humidity was 80%. The light-sensitive materials were then processed in the same manner as that described above. Dmax and Dmin of the resulting images were measured. The results are also shown in Table 3.

TABLE 3

| Light-sensitive material | Compound of invention | | Immediately after preparation | | After storage at 45° C. and RH of 80% for 7 days | |
|---|---|---|---|---|---|---|
| | | | Dmax | Dmin | Dmax | Dmin |
| 101 | Comp. EX. | Cyan | 2.30 | 0.25 | 2.32 | 0.36 |
| | | magenta | 2.15 | 0.16 | 2.16 | 0.36 |
| | | yellow | 2.10 | 0.18 | 2.10 | 0.40 |
| 102 | (1) | cyan | 2.25 | 0.13 | 2.27 | 0.22 |
| | | magenta | 2.12 | 0.13 | 2.12 | 0.23 |
| | | yellow | 2.05 | 0.14 | 2.04 | 0.25 |
| 103 | (8) | cyan | 2.21 | 0.12 | 2.24 | 0.23 |
| | | magenta | 2.10 | 0.13 | 2.12 | 0.21 |
| | | yellow | 2.08 | 0.14 | 2.08 | 0.24 |
| 104 | (16) | cyan | 2.26 | 0.11 | 2.26 | 0.21 |
| | | magenta | 2.13 | 0.12 | 2.10 | 0.23 |
| | | yellow | 2.05 | 0.13 | 2.07 | 0.22 |
| 105 | (10) | cyan | 2.22 | 0.12 | 2.25 | 0.23 |
| | | magenta | 2.10 | 0.14 | 2.08 | 0.23 |
| | | yellow | 2.02 | 0.14 | 2.04 | 0.25 |

It was found that when the compounds of the present invention were added, Dmin could be lowered and the storage stability of the light-sensitive material could be improved.

EXAMPLE 2

The procedure of Example 1 was repeated except that $Zn(OH)_2$ was omitted from the second layer and fourth layer (interlayer) of light-sensitive materials 101 to 105 and 0.30 g of $Zn(OH)_2$ was added to each of the first layer, third layer and fifth layer (light-sensitive layer) thereof to prepare light-sensitive materials 201 to 205. It was found that when the compounds of the present invention were added, Dmin could be lowered and the storage stability of the light-sensitive material could be improved.

EXAMPLE 3

Emulsion (I) for the first layer was prepared in the following manner.

To a well-stirred aqueous gelatin solution (the solution being composed of 1000 ml of water containing 20 g of gelatin and 3 g of sodium chloride and the temperature thereof being kept at 75° C.) were added 600 ml of an aqueous solution containing sodium chloride and potassium bromide and an aqueous nitric acid solution (prepared by dissolving 0.59 mol of silver nitrate in 600 ml of water) simultaneously at an equal flow rate over a period of 40 minutes.

In this way, there was prepared a monodisperse cubic silver chlorobromide (bromine content: 80 mol%) having a mean grain size of 0.35 μ.

After water washing and desalting, 5 mg of sodium thiosulfate and 20 mg of 4-hydroxy-6-methyl-1,3,3a,-7tetrazaindene were added thereto and chemical sensitization was carried out at 60° C. The yield of the emulsion was 600 g.

Emulsion (II) for the third layer was prepared in the following manner.

To a well-stirred aqueous gelatin solution (the solution being composed of 1000 ml of water containing 20 g of gelatin and 3 g of sodium chloride and the temperature thereof being kept at 75° C.) were added 600 ml of an aqueous solution containing sodium chloride and potassium bromide, an aqueous silver nitrate solution (prepared by dissolving 0.59 mol of silver nitrate in 600 ml of water) and the following dye solution (I) simultaneously at an equal flow rate over a period of 40 minutes. In this way, there was prepared a monodisperse cubic silver chlorobromide emulsion (bromine content: 80 mol%) having a mean grain size of 0.35 μ and containing the dye adsorbed thereon.

After water washing and desalting, 5 mg of sodium thiosulfate and 20 mg of 4-hydroxy-6-methyl-1,3,3a,-7-tetrazaindene were added thereto and chemical sensitization was carried out at 60° C. The yield of the emulsion was 600 g.

Dye solution (I)

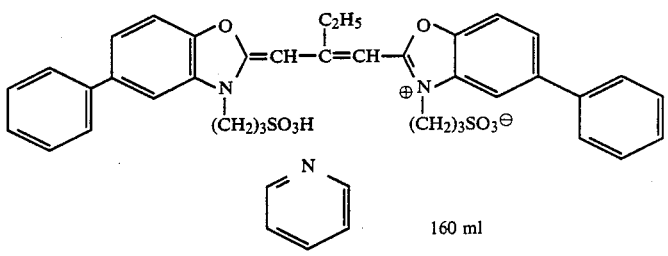

160 ml

Methanol 400 mg

Silver halide emulsion (III) for the fifth layer was prepared in the following manner.

To a well-stirred aqueous gelatin solution (the solution being prepared by dissolving 20 g of gelatin and ammonium hydroxide in 1000 ml of water and the temperature thereof being kept at 50° C.) were added 1000 ml of an aqueous solution containing potassium iodide and potassium bromide and an aqueous solution of silver nitrate (prepared by dissolving one mol of silver nitrate in 1000 ml of water) simultaneously, while keeping the pAg constant. In this way, there was prepared a monodisperse octahedral silver iodobromide emulsion (iodine content: 5 mol%) having a mean grain size of 0.5 μ.

After water washing and desalting, 5 mg of chloroauric acid (tetrahydrate) and 2 mg of sodium thiosulfate were added thereto and gold and sulfur sensitization was carried out at 60° C. The yield of the emulsion was 1.0 kg.

The same dye providing substances as in Example 1 were used. Unless otherwise indicated, other materials used were as in Example 1. Color light-sensitive material 301 of Table 4 was prepared.

TABLE 4

| Layer No. | Layer | Additive | Amount added ($g/m^2$) |
|---|---|---|---|
| Sixth layer | protective layer | gelatin | 0.91 |
| | | matting agent (silica) | 0.03 |
| | | surfactant (1)* | 0.06 |
| | | surfactant (2)* | 0.13 |
| | | hardening agent (1)* | 0.01 |
| | | base precursor (1)* | 0.30 |
| Fifth layer | blue-sensitive layer | emulsion (III) silver amount | 0.30 |
| | | organic silver salt emulsion silver amount | 0.25 |
| | | gelatin | 1.00 |
| | | anti-fogging agent precursor (1)* | 0.07 |
| | | yellow dye providing substance (1) | 0.50 |
| | | high-boiling point organic solvent (1)* | 0.75 |
| | | electron donor (ED-6) | 0.35 |
| | | surfactant (3)* | 0.05 |
| | | electron transfer agent (X-2) | 0.04 |
| | | thermal solvent (1)* | 0.20 |
| | | hardening agent | 0.01 |
| | | base precursor (1)* | 0.27 |
| | | water-soluble polymer (2) | 0.02 |
| Fourth layer | interlayer | gelatin | 0.75 |
| | | reducing agent (ED-6) | 0.25 |
| | | high-boiling point organic solvent (1)* | 0.07 |
| | | surfactant (1)* | 0.02 |
| | | surfactant (4)* | 0.07 |
| | | water-soluble polymer (2)* | 0.02 |
| | | hardening agent (1)* | 0.01 |
| | | base precursor (1)* | 0.25 |
| Third layer | green-sensitive layer | emulsion (II) silver amount | 0.20 |
| | | organic silver salt emulsion silver amount | 0.20 |
| | | gelatin | 0.85 |
| | | anti-fogging agent precursor (1)* | 0.04 |
| | | magenta dye providing substance (2) | 0.37 |
| | | high-boiling point organic solvent (1)* | 0.55 |
| | | electron donor (ED-6) | 0.20 |
| | | surfactant (3)* | 0.04 |
| | | electron transfer agent (X-2) | 0.04 |
| | | thermal solvent (1)* | 0.16 |
| | | hardening agent (1)* | 0.01 |
| | | base precursor (1)* | 0.25 |
| | | water-soluble polymer (2)* | 0.02 |
| Second layer | interlayer | gelatin | 0.80 |
| | | reducing agent (ED-6) | 0.25 |
| | | high-boiling point organic solvent (1)* | 0.07 |
| | | surfactant (1)* | 0.06 |
| | | surfactant (4)* | 0.10 |
| | | water-soluble polymer (2)* | 0.03 |
| | | base precursor (1)* | 0.25 |
| | | hardening agent (1)* | 0.01 |
| First layer | red-sensitive layer | emulsion (II) silver amount | 0.20 |
| | | organic silver salt emulsion silver amount | 0.20 |
| | | sensitizing dye (1)* | $1.07 \times 10^{-3}$ |
| | | gelatin | 0.85 |
| | | anti-fogging agent precursor (1)* | 0.04 |
| | | thermal solvent (1)* | 0.16 |
| | | base precursor (1)* | 0.25 |
| | | cyan dye providing substance (9) | 0.40 |
| | | high-boiling point organic solvent (1)* | 0.60 |
| | | electron donor (ED-6) | 0.14 |
| | | surfactant (3)* | 0.04 |
| | | electron transfer agent (X-2) | 0.04 |
| | | hardening agent (1)* | 0.01 |
| | | water-soluble polymer (2)* | 0.02 |
| Support (polyethylene terephthalate of 100μ in thickness) | | | |
| Backing layer | | carbon black | 0.44 |
| | | polyester | 0.30 |
| | | polyvinyl chloride | 0.30 |

Anti-fogging agent precursor (1)*

-continued

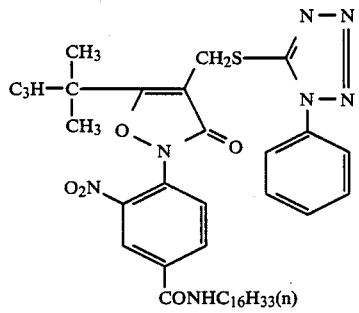

Thermal solvent (1)* benzenesulfonamide
Base precursor (1)* 4-chlorophenylsulfonylacetic acid guanidine The procedure for the preparation of the light-sensitive material 301 was repeated except that compound (8) of the present invention in an amount of 0.5 time (by mol) that of the dye providing substance was added to each layer of the first, third and fifth layers to prepare light-sensitive material 302 having the same layer arrangement as that of light-sensitive material 301.

The organic silver salt emulsion used was prepared in the following manner.

20 g of gelatin and 5.9 g of 4-acetylaminophenylpropiolic acid were dissolved in 1000 ml of an aqueous solution of 0.1 % sodium hydroxide and 200 ml of ethanol. The resulting solution was kept at 40° C. and stirred.

A solution of 4.5 g of silver nitrate in 200 ml of water was added to said solution.

The pH of the resulting dispersion was adjusted to allow salt to be precipitated. Excess salt was removed in a conventional manner. The pH of the dispersion was adjusted to 6.3, thus obtaining the dispersion of the organic silver salt. Yield: 300 g. The pH adjustment was carried out in a conventional manner.

Dye fixing material R-2 was prepared in the following manner.

10 g of poly(methyl acrylate-co-N,N,N-trimethyl-N-vinylbenzylammonium chloride) (the ratio of methyl acrylate to vinylbenzylammonium chloride being 1:1) was dissolved in 200 ml of water. The solution was uniformly mixed with 100 g of 10% lime-processed gelatin. A hardening agent was added to the mixed solution.

A polyethylene-laminated paper support (polyethylene containing titanium dioxide uniformly dispersed therein) was uniformly coated with the resulting mixed solution in such an amount as to give a wet film of 90 μm in thickness. The resulting sample was dried to provide dye-fixing material R-2 having a mordant layer.

Light-sensitive materials 301 and 302 were imagewise exposed and uniformly heated on a block heated to 150° C. for 20 seconds.

After water in an amount of 20 ml/m$^2$ was fed to the film surface side of dye fixing material R-2, each of the heat-treated light-sensitive materials and the dye fixing material were put upon each other in such a manner that the silver halide emulsion side of the light-sensitive material was brought into intimate contact with the dye receiving surface side of the dye fixing material.

After the laminate was heated on a heated block at 80° C. for 6 seconds, the dye fixing material was peeled off the light-sensitive material. There was obtained a color image on the dye fixing material.

Dmax and Dmin of each of the yellow, magenta and cyan colors were measured. The results are shown in Table 5.

In another series, the light-sensitive materials were stored for 7 days under such conditions that the temperature was 45° C. and relative humidity was 80%. The light-sensitive materials were then processed in the same manner as that described above. Dmax and Dmin of the resulting image were measured. The results are shown in Table 5.

TABLE 5

| Light-sensitive material | Compound of invention | | Immediately after preparation | | After storage at 45° C. and RH of 80% for 7 days | |
|---|---|---|---|---|---|---|
| | | | Dmax | Dmin | Dmax | Dmin |
| 301 | Comp. EX. | Cyan | 2.18 | 0.25 | 2.25 | 0.48 |
| | | magenta | 2.15 | 0.23 | 2.20 | 0.44 |
| | | yellow | 2.03 | 0.26 | 2.08 | 0.41 |
| 302 | (8) | Cyan | 2.15 | 0.20 | 2.18 | 0.29 |
| | | magenta | 2.10 | 0.18 | 2.12 | 0.26 |
| | | yellow | 2.00 | 0.20 | 2.02 | 0.28 |

It was found that when the compound of the present invention was used, Dmin could be lowered and the storage stability of the light-sensitive material could be improved.

While the invention has been described in detail and with reference to specific embodiments thereof, it will be apparent to one skilled in the art that various changes and modifications can be made therein without departing from the spirit and scope thereof.

What is claimed is:

1. A heat developable color light-sensitive material comprising a support having thereon at least a light-sensitive silver halide, a reducing agent and/or a reducing agent precursor, a binder, a dye providing substance which releases a mobile dye in counter-correspondence to a latent image formed by imagewise exposure, and an oxidizable compound which has a single bond cleaved by reduction and which does not release any substance having a photographic effect, wherein said compound whose single bond is cleaved by reduction is a compound having an N-X bond which is a nitrogen-to-oxygen bond, a nitrogen-to-nitrogen bond or a nitrogen-to-sulfur bond and which is cleaved by reduction, represented by the following formula (I):

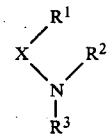

(I)

wherein $R^1$, $R^2$ and $R^3$ each represents a substituent group other than a hydrogen atom and at least one of $R^1$, $R^2$ $R^3$ is an electron-accepting group; X is an oxygen atom, a sulfur atom or a group of the formula

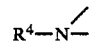

which contains a nitrogen atom, wherein $R^4$ is a mere bond or a substituent group other than a hydrogen atom, and when X is a group of the formula

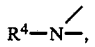

at least one group of $R^1$, $R^2$, $R^3$, or $R^4$ is an electron-accepting group; or $R^1$ and $R^2$, $R^2$ and $R^3$, $R^3$ and $R^4$, or $R^4$ and $R^1$ may be combined together to form a ring.

2. A heat developable color light-sensitive material as in claim 1, wherein said compound represented by formula (I) is a compound represented by the following formula (II):

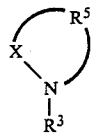

(II)

wherein $R^5$ represents a group which is combined with X and N to form a three-membered to eight-membered heterocyclic ring; X is the same as set forth in formula (I) and at least one of $R^3$ and $R^5$ is an electron-accepting group.

3. A heat developable color light-sensitive material as in claim 1, wherein said electron-accepting group is represented by the following formula (EAG):

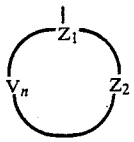

(EAG)

wherein $Z_1$ represents

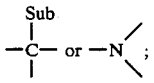

$V_n$ represents an atomic group which forms a three-membered to eight-membered ring together with $Z_1$ and $Z_2$; $Z_2$ represents

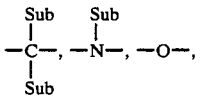

—O—, —S— or —$SO_2$—; Sub represents a mere bond, a hydrogen atom or a substituent group; and n is an integer of from 3 to 8.

4. A heat developable color light-sensitive material as in claim 1, wherein said reducing agent and/or reducing agent precursor is a combination of an electron donor or precursor thereof and an electron transfer agent or precursor thereof.

5. A heat developable color light-sensitive material as in claim 4, wherein said electron donor or precursor thereof is represented by formulae (C) or (D):

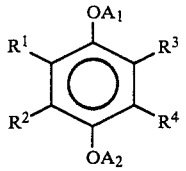

(C)

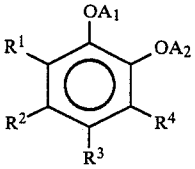

(D)

wherein $A^1$ and $A^2$ each represents hydrogen atom or a phenolic hydroxyl group as protective group which can be protected from elimination by a nucleophilic reagent; and $R^1$ to $R^4$ each represents hydrogen atom, an alkyl group, an aryl group, an alkylthio group, an arylthio group, a sulfonyl group, a sulfo group, a halogen atom, a cyano group, a carbamoyl group, a sulfamoyl group, an amido group, an imido group, a carboxyl group, or a sulfonamido group.

6. A heat developable color light-sensitive material as in claim 4, wherein said electron transfer agent or precursor thereof is represented by formulae (XI) or (XII):

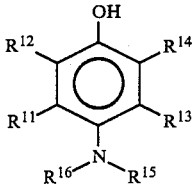

[X-I]

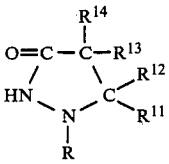

[X-II]

wherein R represents an aryl group; and $R^{11}$, $R^{12}$, $R^{13}$, $R^{14}$, $R^{15}$ and $R^{16}$ may be the same or different and each represents hydrogen atom, a halogen atom, an acylamino group, an alkoxy group, an alkylthio group, an alkyl group or an aryl group.

7. A heat developable color light-sensitive material as in claim 1, wherein said dye providing compound is represented by the formula (LI):

$$(\text{Dye}-\text{Y})_n-\text{Z} \qquad \text{(LI)}$$

wherein Dye represents a dye group, a dye group which has been temporarily shifted to a short wavelength range or a dye precursor group; Y represents a mere bond or connecting group; Z represents a group which makes a difference in the diffusibility of the compound represented by $(\text{Dye}-\text{Y})_n-\text{Z}$ in corresponding or counter-corresponding to light-sensitive silver salts having a latent image distributed imagewise or releases Dye in corresponding or counter-corresponding to light-sensitive silver salts having a latent image distributed imagewise to make no difference in the diffusibility between Dye thus released and $(\text{Dye}-\text{Y})_n-\text{Z}$; and n represents an integer of 1 or 2, provided that if n is 2, two (Dye—Y)'s may be the same or different.

8. A process for forming a color image which comprises heat developing a color light-sensitive material as claimed in claim 1, which process comprises imagewise exposing said color light-sensitive material, and thereafter heating the same to release the dye from the dye providing substance, and simultaneously with or after said heating, transferring said dye released from said dye providing substance to an image-receiving material.

* * * * *